US011414107B2

(12) United States Patent
Hematian

(10) Patent No.: US 11,414,107 B2
(45) Date of Patent: Aug. 16, 2022

(54) RAILROAD CAR TRUCK DAMPER WEDGE FITTINGS

(71) Applicant: National Steel Car Limited, Hamilton (CA)

(72) Inventor: Jamal Hematian, Burlington (CA)

(73) Assignee: NATIONAL STEEL CAR LIMITED, Hamilton (CA)

( * ) Notice: Subject to any disclaimer, the term of this patent is extended or adjusted under 35 U.S.C. 154(b) by 210 days.

(21) Appl. No.: 16/660,582

(22) Filed: Oct. 22, 2019

(65) Prior Publication Data

US 2021/0114632 A1 Apr. 22, 2021

(51) Int. Cl.
*B61F 5/12* (2006.01)
*B61F 5/06* (2006.01)

(52) U.S. Cl.
CPC ..... *B61F 5/122* (2013.01); *B61F 5/06* (2013.01)

(58) Field of Classification Search
CPC .... B61F 5/122; B61F 5/06; B61F 5/00; B61F 5/12; B61F 5/125; B61F 5/34; B61F 5/40; B61F 5/42; B61F 5/44; B61F 5/50; B61F 5/52
See application file for complete search history.

(56) References Cited

U.S. PATENT DOCUMENTS 2,053,990 A 9/1936 Goodwin
2,129,408 A 9/1938 Davidson
2,257,109 A 9/1941 Davidson
2,324,267 A 7/1943 Oelkers
2,333,921 A 11/1943 Flesch
2,352,693 A 7/1944 Davidson
2,404,278 A 7/1946 Dath
2,408,866 A 10/1946 Marquardt
2,424,936 A 7/1947 Light
(Continued)

FOREIGN PATENT DOCUMENTS

CA 714822 A1 8/1965
CA 2153137 A1 1/1996
(Continued)

OTHER PUBLICATIONS

International Search Report & Written Report in PCT/CA2020/051576 dated Aug. 5, 2021.

*Primary Examiner* — Zachary L Kuhfuss
*Assistant Examiner* — Cheng Lin
(74) *Attorney, Agent, or Firm* — Whiteford, Taylor & Preston, LLP; Barry E. Bretschneider

(57) ABSTRACT

A damper wedge for a railroad car truck includes a friction member that rides on the wear plate of the side frame column of the railroad car truck and a non-metallic wear surface; and a spring seat that, in use, engages a spring of the railroad car truck. The inclined damper wedge surface has a primary angle alpha, and a secondary angle beta. The spring seat has an axial centerline. The inclined damper wedge surface has a curvature. The curvature has a working point. The damper wedge has a datum plane that is normal to the non-metallic wear surface and that contains the axial centerline. The axial centerline meets the inclined damper wedge surface at an intersection point that is the center of a contact patch. The working point is located in a central region of the contact patch, or working surface patch, downslope of the intersection point.

43 Claims, 12 Drawing Sheets

(56) References Cited

U.S. PATENT DOCUMENTS

| | | | | |
|---|---|---|---|---|
| 2,434,583 | A | 1/1948 | Pierce | |
| 2,446,506 | A | 8/1948 | Barrett | |
| 2,456,635 | A | 12/1948 | Heater | |
| 2,458,210 | A | 1/1949 | Schlegel | |
| 2,497,460 | A | 2/1950 | Leese | |
| 2,528,473 | A | 10/1950 | Kowalik | |
| 2,650,550 | A | 9/1953 | Pierce | |
| 2,727,472 | A | 12/1955 | Forssell | |
| 2,751,856 | A | 6/1956 | Maatman | |
| 2,777,400 | A | 1/1957 | Forssell | |
| 2,827,987 | A | 3/1958 | Williams | |
| 2,853,958 | A | 9/1958 | Neumann | |
| 2,883,944 | A | 4/1959 | Couch | |
| 2,911,923 | A | 11/1959 | Bachman | |
| 3,024,743 | A | 3/1962 | Williams | |
| 3,026,819 | A | 3/1962 | Cope | |
| 3,218,990 | A | 11/1965 | Weber | |
| 3,285,197 | A | 11/1966 | Tack | |
| 3,358,614 | A | 12/1967 | Barber | |
| 3,461,815 | A | 8/1969 | Gedris | |
| 3,559,589 | A | 2/1971 | Williams | |
| 3,575,117 | A | 4/1971 | Tack | |
| 3,670,660 | A | 6/1972 | Weber | |
| 3,714,905 | A | 2/1973 | Barber | |
| 3,802,353 | A | 4/1974 | Korpics | |
| 3,855,942 | A | 12/1974 | Mulcahy | |
| 3,901,163 | A | 8/1975 | Neumann | |
| 3,977,332 | A | 8/1976 | Bullock | |
| 4,003,318 | A | 1/1977 | Bullock | |
| 4,084,514 | A | 4/1978 | Bullock | |
| 4,109,585 | A | 4/1978 | Brose | |
| 4,103,623 | A | 8/1978 | Radwill | |
| 4,167,907 | A | 9/1979 | Mulcahy | |
| 4,179,995 | A | 12/1979 | Day | |
| 4,230,047 | A | 10/1980 | Wiebe | |
| 4,254,713 | A | 3/1981 | Clafford | |
| 4,256,041 | A | 3/1981 | Kemper | |
| 4,274,340 | A | 6/1981 | Neumann | |
| 4,276,833 | A | 7/1981 | Bullock | |
| 4,295,429 | A | 10/1981 | Wiebe | |
| 4,357,880 | A | 11/1982 | Weber | |
| 4,370,933 | A | 2/1983 | Mulcahy | |
| 4,426,934 | A | 1/1984 | Geyer | |
| 4,483,253 | A | 11/1984 | List | |
| 4,491,075 | A | 1/1985 | Neumann | |
| 4,574,408 | A | 3/1986 | Dentler | |
| 4,637,319 | A | 1/1987 | Moehling | |
| 4,825,775 | A | 5/1989 | Stein | |
| 4,825,776 | A | 5/1989 | Spencer | |
| 4,915,031 | A | 4/1990 | Webe | |
| 4,953,471 | A | 9/1990 | Wronkiewicz | |
| 4,974,521 | A | 12/1990 | Eungard | |
| 4,986,192 | A | 1/1991 | Wiebe | |
| 5,086,708 | A | 2/1992 | Mckeown, Jr. | |
| 5,095,823 | A | 3/1992 | Mckeown, Jr. | |
| 5,176,083 | A | 1/1993 | Bullock | |
| 5,239,932 | A | 8/1993 | Weber | |
| 5,331,902 | A | 7/1994 | Hawthorne | |
| 5,452,665 | A | 9/1995 | Wronkiewicz | |
| 5,511,489 | A | 4/1996 | Bullock | |
| 5,524,551 | A | 6/1996 | Hawthorne | |
| 5,850,795 | A | 12/1998 | Tailion | |
| 5,875,721 | A | 3/1999 | Wright | |
| 5,921,186 | A | 7/1999 | Hawthorne | |
| 5,943,961 | A | 8/1999 | Rudibaugh | |
| 6,173,655 | B1 | 1/2001 | Hawthorne | |
| 6,186,075 | B1 | 2/2001 | Spencer | |
| 6,227,122 | B1 | 5/2001 | Spencer | |
| 6,276,283 | B1 | 8/2001 | Weber | |
| 6,374,749 | B1 | 4/2002 | Duncan | |
| 6,425,334 | B1 | 7/2002 | Wronkiewicz | |
| 6,701,850 | B2 | 3/2004 | Mccabe | |
| 6,895,866 | B2 * | 5/2005 | Forbes | B61D 3/18 105/197.05 |
| 7,143,700 | B2 * | 12/2006 | Forbes | B61F 5/50 105/223 |
| 7,631,603 | B2 * | 12/2009 | Forbes | B61F 5/32 105/157.1 |
| 7,775,163 | B2 * | 8/2010 | Forbes | B61F 5/122 105/224.1 |
| 7,823,513 | B2 * | 11/2010 | Forbes | B61F 5/38 105/193 |
| 7,908,974 | B2 * | 3/2011 | Hewitt | B61F 5/30 105/224.05 |
| 2003/0024429 | A1 | 2/2003 | Forbes | |
| 2003/0037696 | A1 | 2/2003 | Forbes | |
| 2003/0041772 | A1 | 3/2003 | Forbes | |
| 2003/0129037 | A1 | 7/2003 | Forbes | |
| 2016/0001796 | A1 * | 1/2016 | Hematian | B61F 5/122 105/200 |
| 2020/0269887 | A1 * | 8/2020 | Samarkina | B61F 5/52 |

FOREIGN PATENT DOCUMENTS

| | | | |
|---|---|---|---|
| EP | 1053925 | A1 | 4/2003 |
| GB | 377395 | A1 | 7/1932 |

* cited by examiner

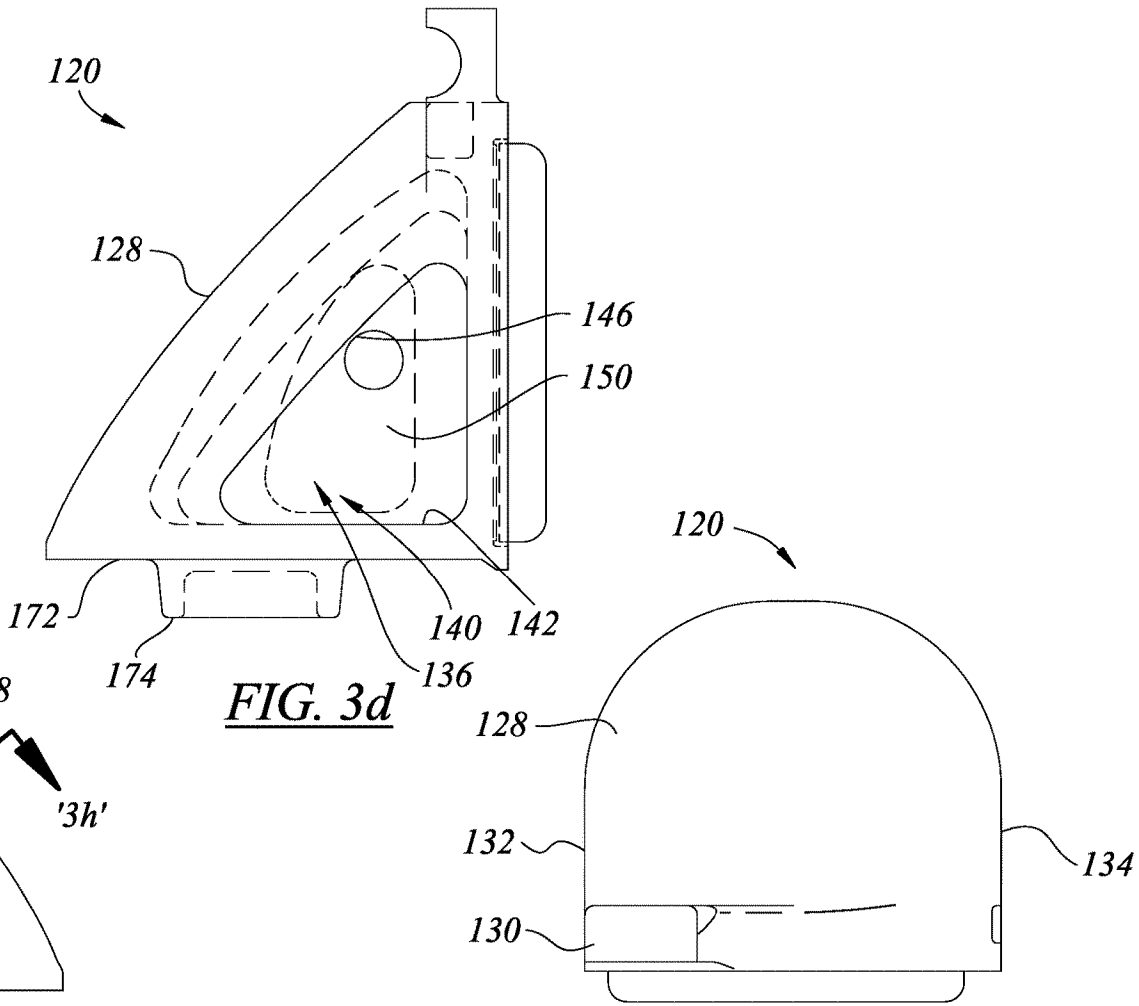
FIG. 3d
FIG. 3e
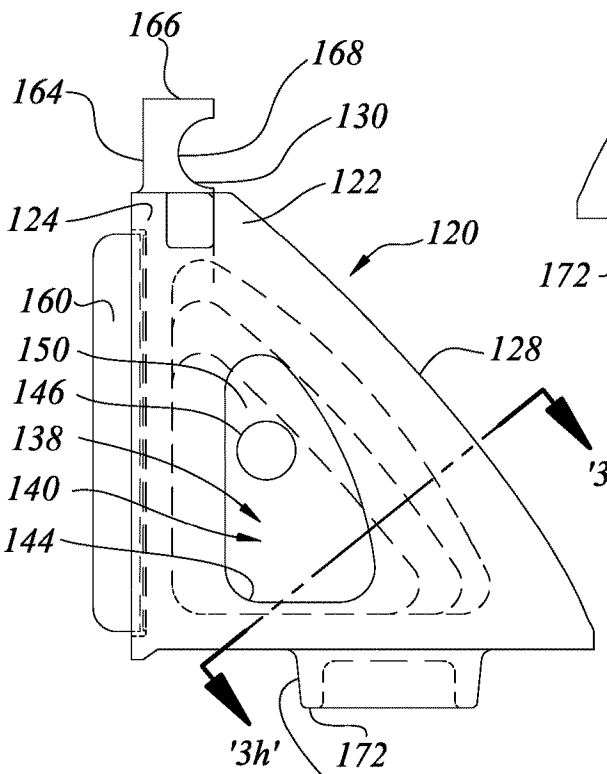
FIG. 3c

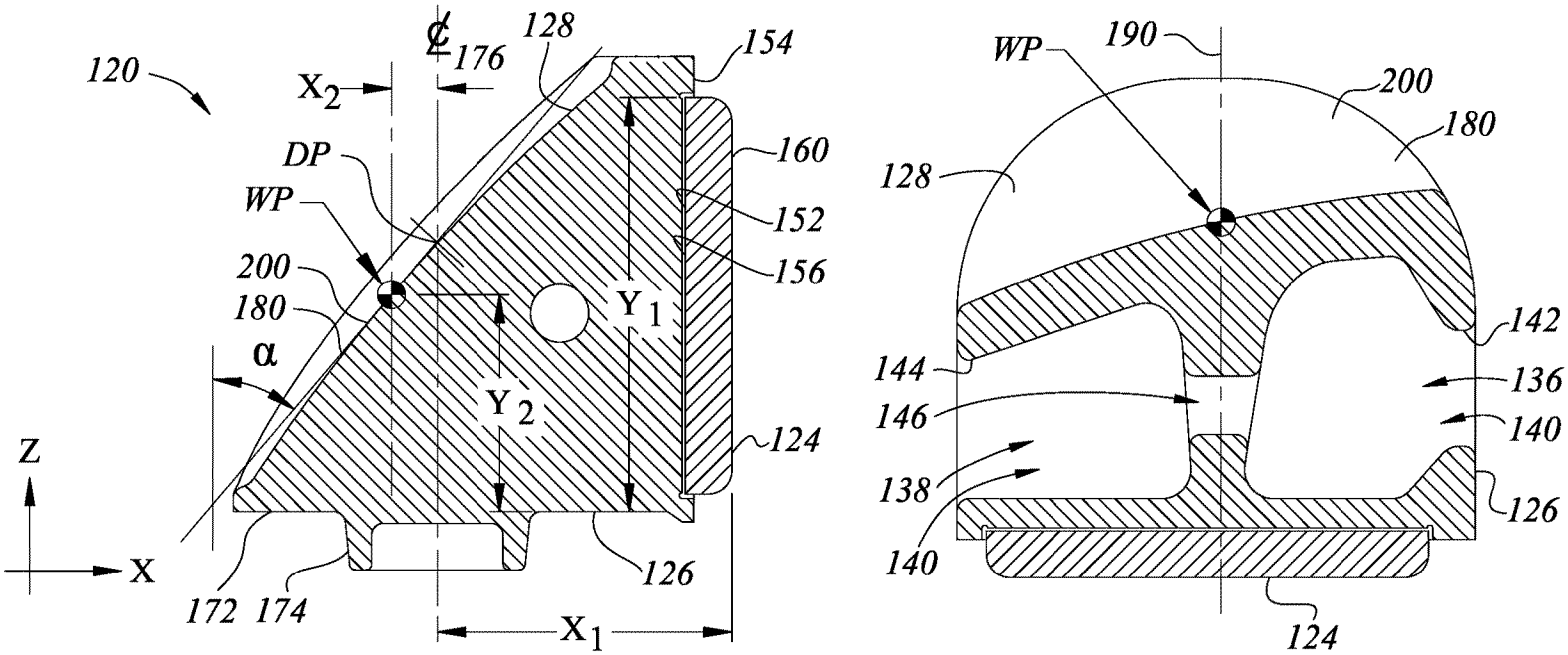
FIG. 3f
FIG. 3g
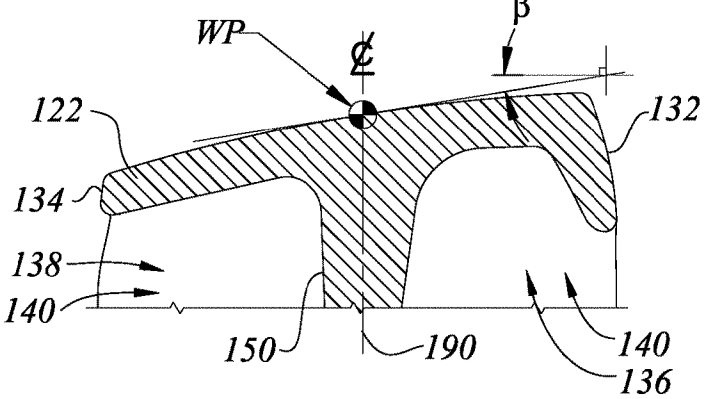
FIG. 3h

RAILROAD CAR TRUCK DAMPER WEDGE FITTINGS

FIELD OF THE INVENTION

This invention relates to the field of damper fittings for bolsters of railroad car trucks.

BACKGROUND

The problem of the ride quality of railroad freight car trucks has endured for many years. Previous attempts to address this problem are seen in WO 2005 005219 of Forbes and Hematian. As explained in that application, ride quality tends to involve the often subtle inter-relationship of dynamic responses in multiple degrees of freedom at multiple reaction interfaces.

The relationship between the self-steering response at the interface between the bearing adapters and the side frame pedestals, and the coincident lateral swinging motion at the same interface; and the response at the interface between the truck bolster and the side frames both contribute to overall ride quality, the damping of all of these motions being provided by the friction dampers. Most often these dampers have the form of triangular wedges mounted to work between the bolster and the side frame columns. The type of friction interface makes a difference in performance. That is, for many years friction was provided by the sliding engagement of steel (or cast iron) on steel. More recently, damper wedges have been used with non-metallic working surfaces, or pads, that bear on the side frame column wear plates.

It had been assumed that the normal force to the friction face of the damper wedge could be reasonably approximated by a point load through the center of the friction face, or by a distributed load that was either of uniform magnitude across the friction face, or as a load distribution that effectively had its center in the middle of the friction face.

This assumption may have been adequate for previous approximations. However, more recent observations have been that the force on the friction face is distributed quite differently from the previous assumption. That is, the pad tends to wear predominantly on the top edge during upward motion of the bolster relative to the side frame, and on the bottom edge during downward motion of the bolster. Moreover, whereas it had been assumed that the distribution of forces would be roughly the same from damper wedge to damper wedge, actual observation indicates that force distribution on the front face of the friction damper wedge is surprisingly sensitive to manufacturing tolerances and variations on the rear face of the damper wedge.

Where the edge of the non-metallic friction pad is worn off, the underlying metallic parts may then have a tendency to score and gouge each other. This will most probably affect the performance of the truck, which is not desirable.

Given the inconvenience of changing friction damper wedges undesirably frequently, or at unexpected intervals, the variability between damper wedge parts, the variability in ride performance, and the variability in wear pad life consequent on such variability present a challenge.

SUMMARY OF THE INVENTION

The invention relates to a friction damper wedge design which has a non-metallic friction face that engages in a sliding motion against the side frame column wear plate. The friction damper wedge has an inclined curved surface that has a working point at a specific location which cooperates with a corresponding bolster pocket. The location of the working point is such that when it engages the bolster pocket it will result in a more uniformly distributed load on the friction face.

In an aspect of the invention there is a damper wedge for a railroad car truck. The damper wedge is formed to co-operate with a bolster pocket that has a primary damper angle, alpha, and a secondary damper angle, beta. The damper wedge has a friction member that, in use, movably engages a wear surface of a side frame column of the railroad car truck. The friction member has a non-metallic wear surface. There is a spring seat that, in use, engages a spring of the railroad car truck. There is an inclined damper wedge surface has the primary angle alpha and the secondary angle beta. The inclined damper wedge surface has a curvature. The curvature has a working point, WP. The spring seat has an axial centerline. The damper wedge has a datum plane that is normal to the non-metallic wear surface and that contains the axial centerline. The axial centerline meets the inclined damper wedge surface at an intersection point. The working point is located in a central region of the inclined damper wedge surface adjacent to the datum plane, downslope from the intersection point.

In a feature of that aspect, the working point is offset between ⅛" and ⅝" further away from the non-metallic wear surface of the friction member than is the axial centerline. In another feature, the working point is offset between ¼" and ¾" further away from the non-metallic wear surface of the friction member than is the axial centerline. In still another feature, the non-metallic wear surface is offset from the axial centerline by a first distance, $x_1$; the working point is offset from the centerline by a second distance $x_2$; and a ratio of $x_1$:$x_2$ is in the range of one of (a) 21:2 to 21:8; and (b) 10:3 to 40:3. In still another feature, the ratio is about 5:1. In a further feature, the non-metallic wear surface has an overall height $y_1$ and the working point lies in the range of ⅜ to ⅝ of $y_1$ up the height of the non-metallic wear surface.

In still yet another feature, the curvature is a compound curvature. In an additional feature, the curvature of the inclined surface is spherical. In a still further feature, the curvature has a radius of curvature of less than 35 inches. In another feature, the radius is in range of 15-30 inches. In still another feature, angle alpha is between 30 deg and 50 deg. In another feature, angle beta is between 5 degrees and 20 deg. In another feature, the inclined surface has a working surface patch, or contact patch, that has a radius of less than 2 inches.

In still another feature, the damper wedge has first and second end walls; the inclined surface is located between the first and second end walls, and the datum plane is mid-way between the first and second end walls. In a further feature, the inclined surface extends to the first and second end walls. In a further feature, the damper wedge includes an internal web extending between the inclined damper wedge surface and the friction member, and the working point is aligned with the internal web. In another feature, the working point is along the datum plane. In another feature, the damper wedge is at least partially hollow. In another feature, the damper wedge includes a lifting lug.

In another feature, the spring seat includes a downwardly protruding boss sized to sit co-axially within a spring of the railroad car truck. In a further feature, the damper wedge is used in combination with a spring group of the railroad car truck. The spring group has a damper spring mounted to co-operate with the spring seat for the damper. There is at least a first main spring. The first damper spring has a greater free height than does the first main spring. In yet another feature, the spring seat is defined in a base wall of the damper wedge; the damper wedge has rearwardly radiused corners, the corners has a radius greater than ¼ of the width of the damper wedge, and the inclined damper wedge surface terminates at the outer edge of at least one of the radiused corners. In still another feature, there are four of the damper wedges in a set for one end of a bolster of the truck, the four damper wedges including two damper wedges with a left-hand beta angle, and two of damper wedges has a right-hand beta angle. In another feature, the damper wedge is combined with the bolster pocket.

In still another feature, there is a railroad car truck that has the combination of the damper wedge and at least one self-steering apparatus. In a further feature, the self-steering apparatus includes a rocker located between a side frame pedestal and a wheelset axle bearing. In still another feature, the railroad car truck has a side frame mounted to rock laterally sideways, the side frame has a lateral rocking stiffness $k_{pendulum}$; the railroad car truck has a bolster mounted on spring groups, the spring groups has a lateral stiffness $k_{springshear}$, and $k_{pendulum}$ is less than $k_{springshear}$.

In another aspect of the invention there is a damper wedge for a railroad car truck. The damper wedge is formed to co-operate with a bolster pocket has a primary damper angle, alpha, and a secondary damper angle, beta. The damper wedge has a friction member that, in use, movably engages a wear surface of a side frame column of the railroad car truck. The friction member has a non-metallic wear surface. There is a spring seat that, in use, engages a spring of the railroad car truck. There is an inclined damper wedge surface, the inclined damper wedge surface has primary angle alpha, secondary angle beta, and a curvature. The curvature has a working point at which the inclined surface engages the bolster pocket when at rest. The spring seat has an axial centerline. The damper wedge has a datum plane that is normal to the non-metallic wear surface and that contains the axial centerline. The axial centerline meets the inclined damper wedge surface at an intersection point. The damper wedge has a first end face and a second end face. The first and second end faces are is spaced apart and opposed. The datum plane is located midway between the first and second end faces. The working point is located in a central region defined adjacent the datum plane, downslope from the intersection point. In another feature, the radius of curvature in the datum plane is less than 30 inches. In still another feature, the damper wedge has first and second end faces. The datum plane defined at mid-point between the first and second end faces. The damper wedge is asymmetric.

The features enumerated in respect of the preceding aspect of the invention are also applicable in respect of the foregoing aspect.

In still another aspect there is a damper wedge for a railroad car truck. The damper wedge is sized to seat within a mating bolster pocket of a bolster of the railroad car truck. The damper wedge has a body. The body has a friction face operable to engage a side frame column of the railroad car truck. The friction face has a non-metallic wear surface. The body has a spring seat sized to mate with an upper end of a spring of a spring of the railroad car truck. The body has an inclined face that is formed to engage a corresponding inclined face of the bolster pocket. The inclined face has a primary damper wedge angle and a secondary damper wedge angle. The inclined face has a curvature. The body has a first side face and an opposed a second side face, and a central plane intermediate the first side face and the second side face. The first side face is larger than the second side face. The central plane is square to the friction face. The central plane intersects the inclined face. The inclined face has a working point that is located on the central plane.

The features enumerated with respect to the previous aspects of the invention are also applicable to the foregoing aspect.

In still another aspect there is a damper wedge operable to engage a bolster pocket of a railroad car truck bolster. The damper wedge has an inclined face has a primary angle, alpha, and a secondary angle beta. The inclined face has an outwardly convex compound surface operable to engage the bolster pocket at a working point. The secondary angle, beta, defines a lateral bias direction of the damper wedge. The damper wedge has a friction face that, in use, engages a side frame column wear surface of the railroad car truck. The friction face has a non-metallic wear surface. The friction face has a normal plane extending therethrough. The normal plane also extends in a direction of the upward and downward sprung motion of the damper wedge in use. The normal plane is also centered intermediate the width of the non-metallic wear surface. The working point lies on the normal plane. The features enumerated with respect to the previous aspects of the invention are also applicable to the foregoing aspect.

In another aspect of the invention there is a damper wedge for a railroad car truck, the damper wedge is formed to co-operate with a corresponding bolster pocket has a primary damper angle, alpha, and a secondary damper angle, beta. The damper wedge has a friction member that, in use, movable engages a wear surface of a side frame column of the railroad car truck. The friction member has a non-metallic wear surface. There is a spring seat that, in use, engages a spring of the railroad car truck. The damper wedge has an inclined damper wedge surface. The inclined damper wedge surface has a primary damper wedge angle, and a secondary damper wedge angle. The inclined damper wedge surface has a curvature. The curvature has a working point. The spring seat has an axial centerline. The damper wedge has a datum plane that is normal to the non-metallic wear surface and that contains the axial centerline. The axial centerline meets the inclined damper wedge surface at an intersection point. The intersection point is the center of a working surface contact patch that has a radius of less than 1.5 inches. The working point is located on the working surface contact patch.

The features enumerated with respect to the previous aspects of the invention are also applicable to the foregoing aspect.

In another aspect, there is a damper wedge for a railroad car truck. It has friction surface that, in use, engages a side frame column wear plate of the railroad car truck. It has a spring seat that, in use, engages a spring, the spring seat having an axial direction. It has a slope surface that, in use, engages a corresponding surface of a bolster pocket of a bolster of the railroad car truck. There is a datum plane normal to the friction surface. The datum plane is parallel to the axial direction of the spring seat. The slope surface has a spherical arc and a radius of curvature. The slope surface has a primary damper wedge angle, and a cross-wise secondary damper wedge angle. The slope surface has a working point that, at equilibrium, engages the bolster pocket in rolling point contact. The radius of curvature of the slope surface has an origin lying to one side of the datum plane. A radius passes through the origin and the working point. The radius diverges from the datum plane at a skew angle, the skew angle being the secondary damper wedge angle when the radius is viewed in a plane oriented at the primary damper wedge angle.

In a feature of that aspect, the axial direction of the spring seat lies in the datum plane, and the working point also lies in the datum plane. In another feature, the radius of curvature is in the range of 15" to 30". In a further feature, the radius of curvature is in the range of 20", +/−1". In another feature, the working point is offset between ⅛" and ⅝" more distant from the non-metallic wear surface of the friction member than is the axial centerline. In a further feature, the working point is offset between ¼" and ¾" more distant from the non-metallic wear surface of the friction member than is the axial centerline. In still another feature, the non-metallic surface is offset from the axial centerline by a first distance, $x_1$; the working point is offset from the centerline by a second distance $x_2$; and a ratio of $x_1$:$x_2$ is in the range of one of (a) 21:2 to 21:8; and (b) 10:3 to 40:3. In another feature, the ratio is 5:1. In still another feature, the axial centerline intersects said sloped surface at a datum point. The datum point lies in the datum plane. The working point is located less than 1 inch from the datum point. The features of the previous aspects of the invention are also applicable to the foregoing aspect.

These and other aspects and features of the invention may be understood with reference to the description that follows, and with the aid of the illustrations.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which:

FIG. 3*c* is a large side view of the damper wedge of FIG. 3*a;*

FIG. 3*d* is a small side view of the damper wedge of FIG. 3*a;*

FIG. 3*e* is a top view of the damper wedge of FIG. 3*a;*

FIG. 3*f* is a sectional view on the spring seat vertical central plane indicated by section '3*f*-3*f*' in FIG. 3*a;*

FIG. 3*g* is a sectional view in the horizontal plane indicated by section '3*g*-3*g*' in FIG. 3*a;*

FIG. 3*h* is a sectional plane taken on the spherical radius through the working point as indicated by section '3*h*-3*h*' of FIG. 3*c;*

DETAILED DESCRIPTION

Figure 1A:
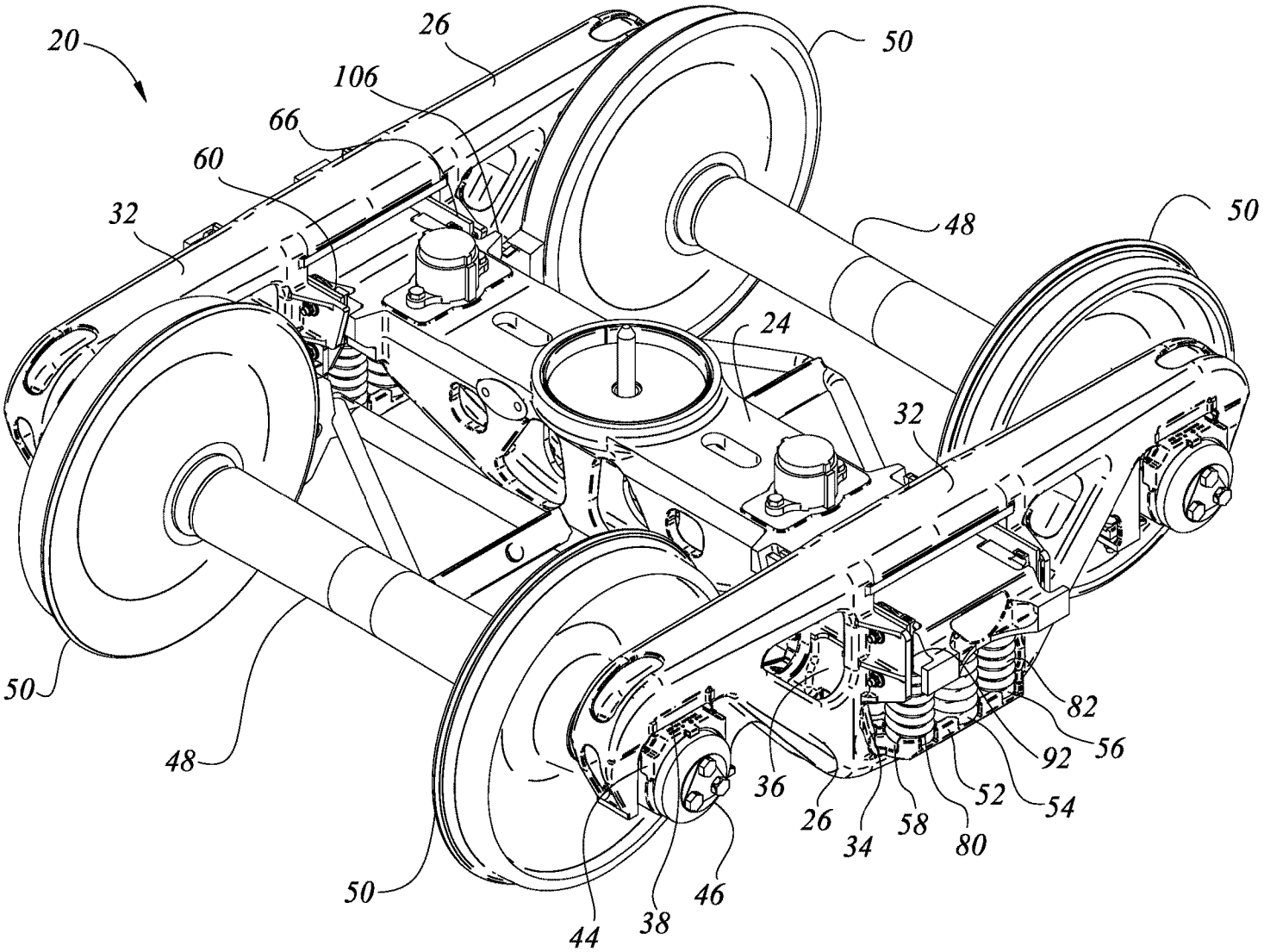
FIG. 1*a* shows an isometric view of an example of an embodiment of a railroad car truck according to an aspect of the present invention.
Figure 1B:
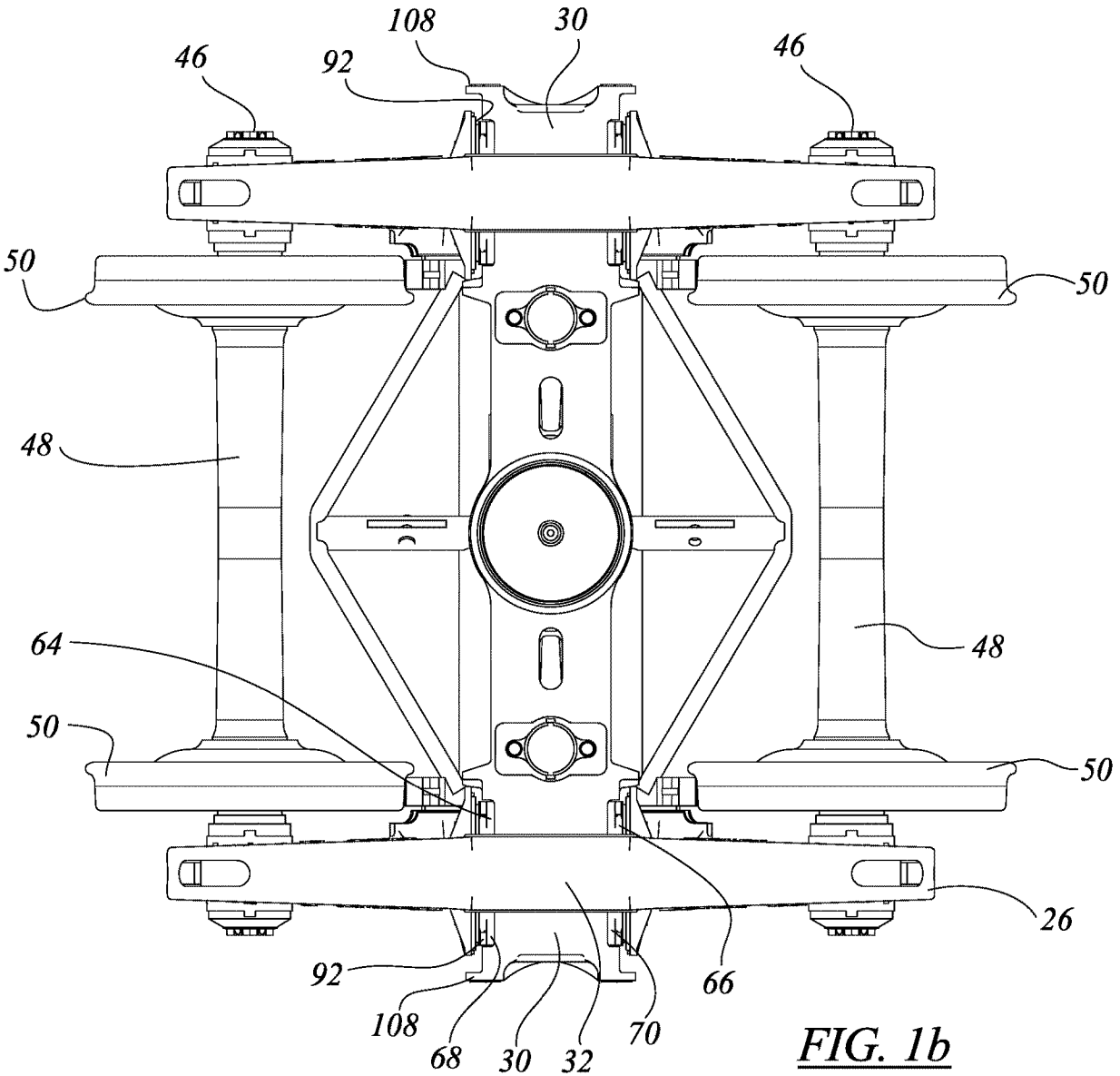
FIG. 1*b* shows a top view of the railroad car truck of FIG. 1*a;*
Figure 1C:
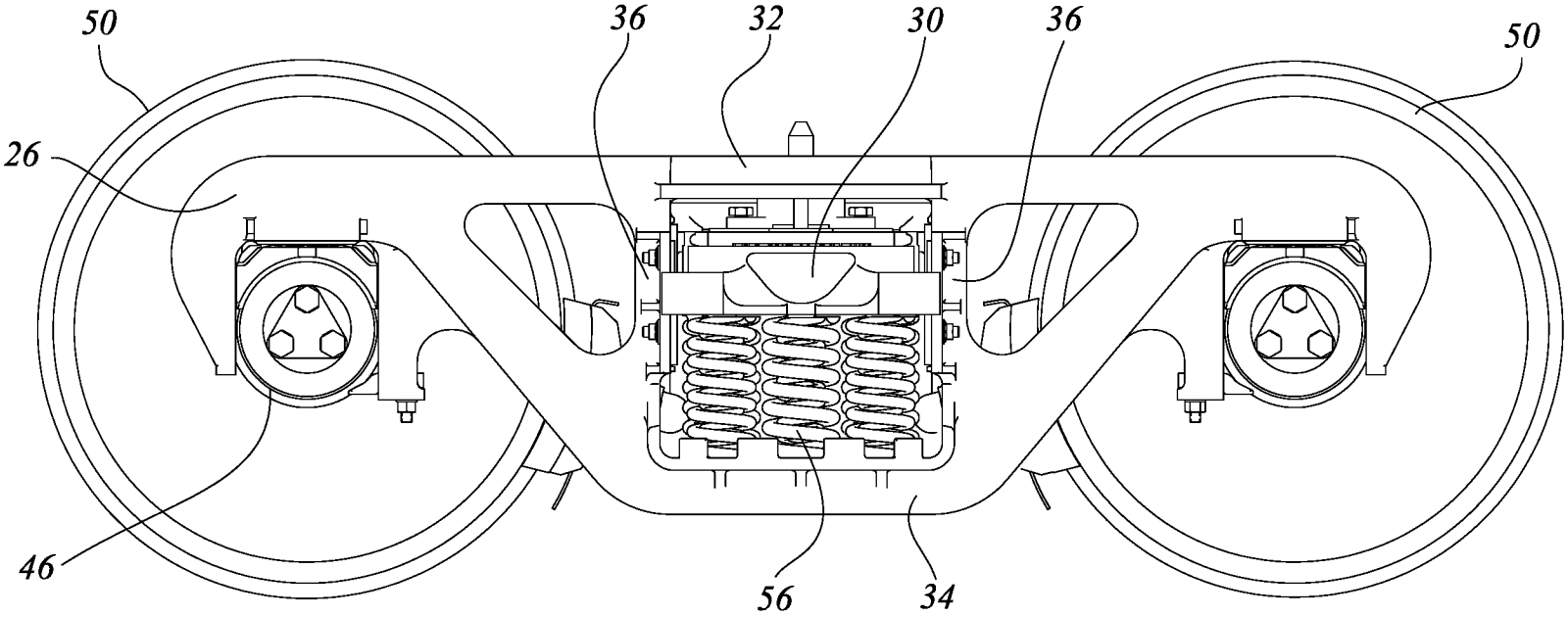
FIG. 1*c* shows a side view of the railroad car truck of FIG. 1*a;*
Figure 1D:
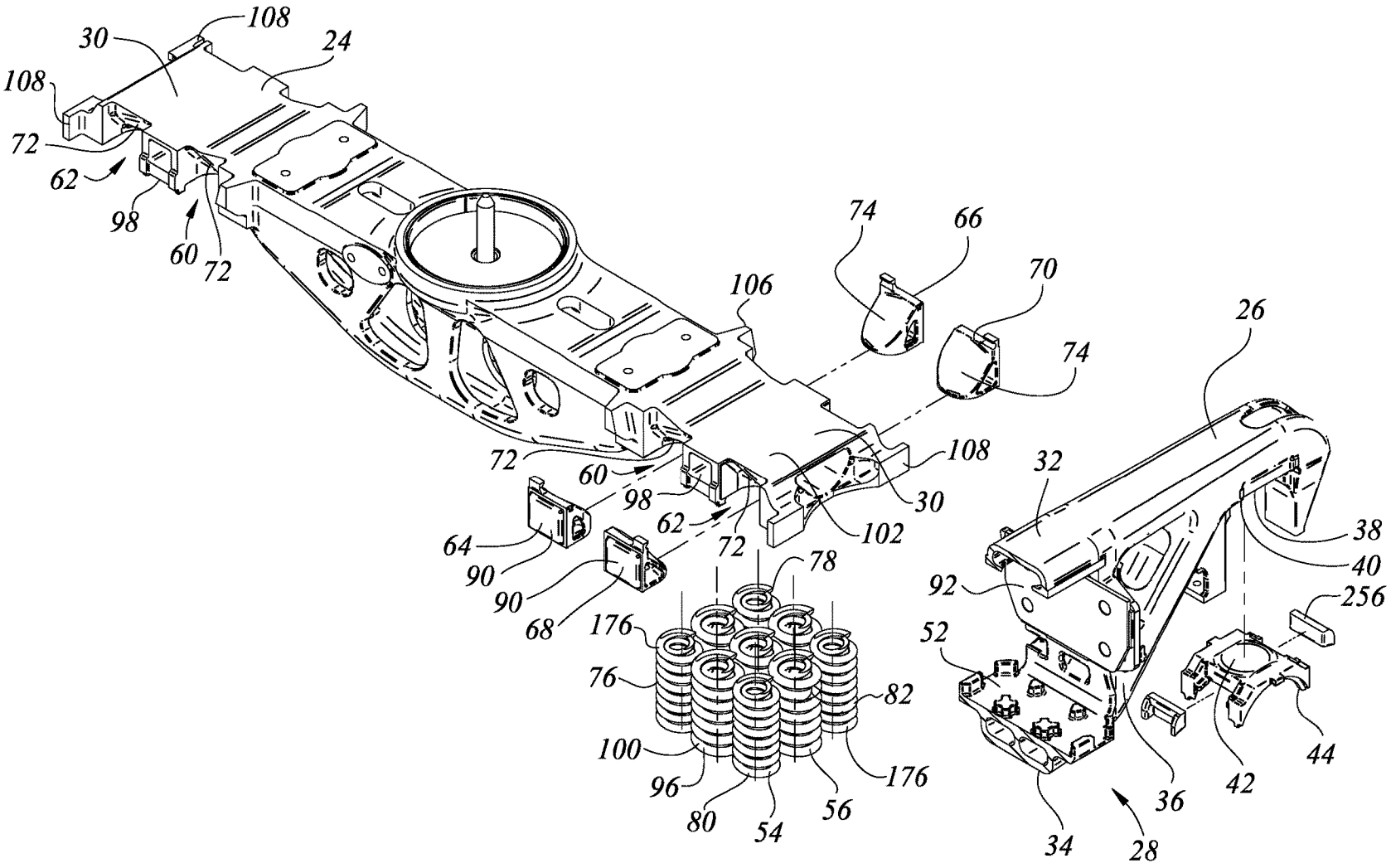
FIG. 1*d* shows an exploded view of a portion of the truck of FIG. 1*a;*
Figure 2A:
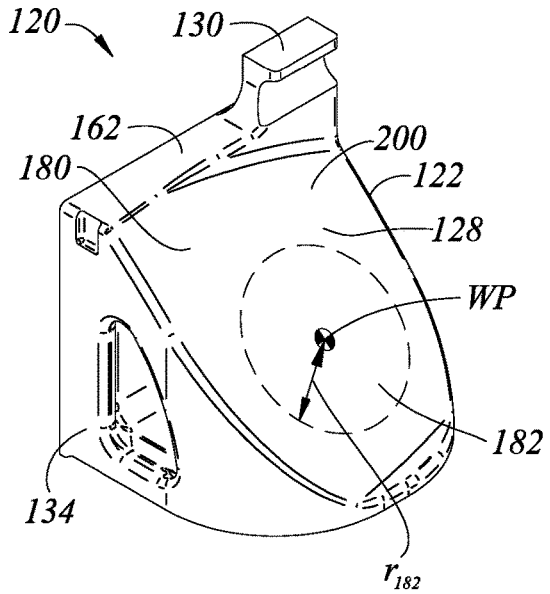
FIG. 2*a* is an isometric view from behind and above of a damper wedge used in the truck of FIG. 1*a;*
Figure 2B:
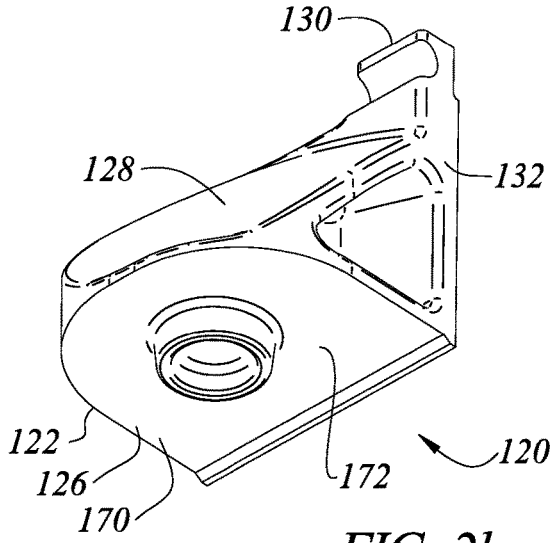
FIG. 2*b* is a view, from below and behind of the damper wedge of FIG. 2*a;*
Figure 2C:
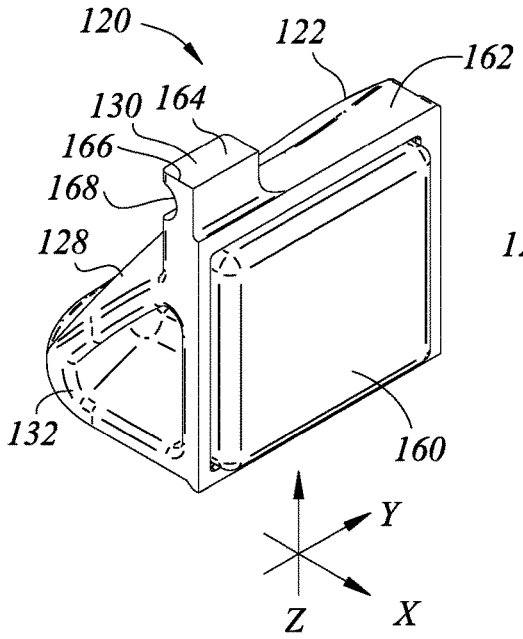
FIG. 2*c* is a view of the damper wedge of FIG. 2*a* from in front and above.
Figure 2D:
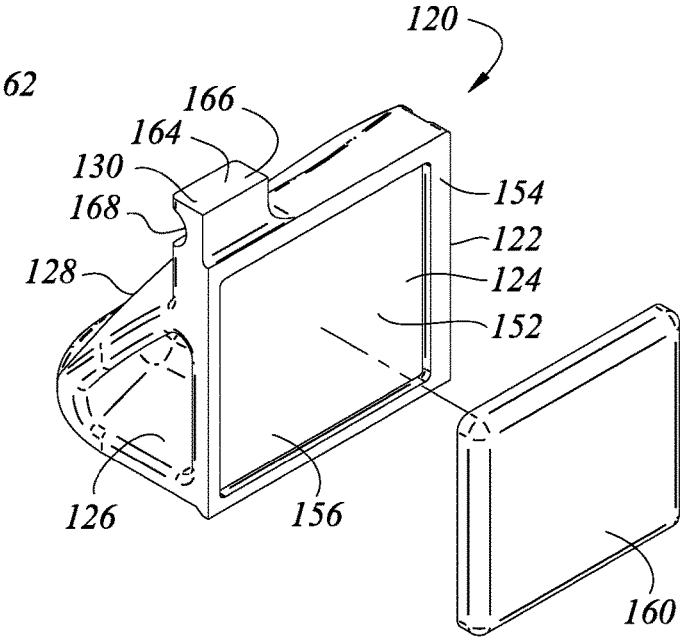
FIG. 2*d* is an exploded view of the damper wedge of FIG. 2*c* with the wear pad out prior to installation.
Figure 3B:
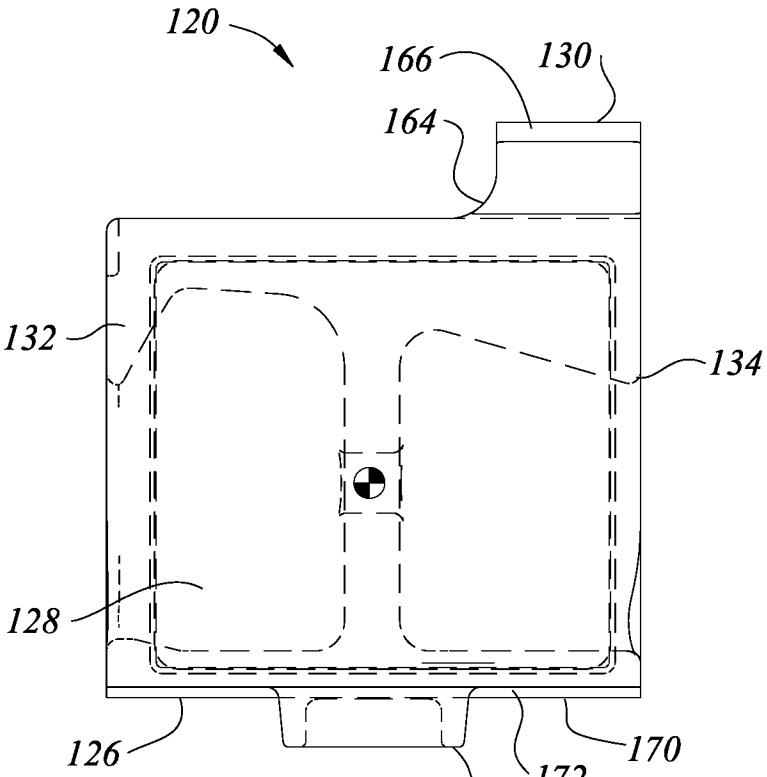
FIG. 3*b* is a rear view of the damper wedge of FIG. 3*a;*
Figure 3A:
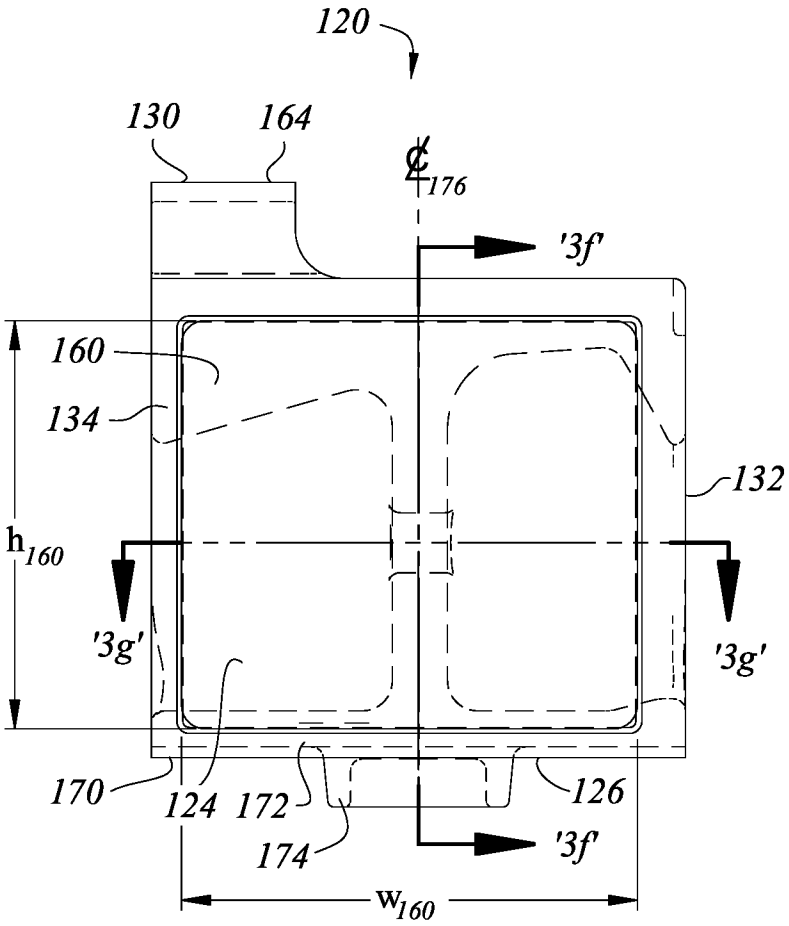
FIG. 3*a* is a front view of the damper wedge of FIG. 2*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as understood by a person of ordinary skill in the railroad industry in North America. In that regard, the Applicant incorporates by reference the Rules and Standards of the Association of American Railroads (AAR), a private body that establishes rules for interchange operation of railroad rolling stock in North America.

Furthermore, this specification frequently recites multiple synonyms for a single object. There is no in haec verba requirement in patent law. The recitation of multiple synonyms is intended to convey that any synonym may be used for a given part, whether or not that synonym is used in the disclosure as filed, provided that it conforms to the meaning of the concept, function, or object conveyed on a fair reading of the disclosure, or that is fairly shown in the illustrative figures, or both.

In terms of general orientation and directional nomenclature, for railroad car trucks described herein the longitudinal direction is defined as being coincident with the rolling direction of the railroad car, or railroad car unit, when located on tangent (that is, straight) track. In a Cartesian frame of reference, this may be defined as the x-axis, or x-direction. In the case of a railroad car having a center sill, be it a stub sill or a straight-through center sill, the longitudinal direction is parallel to the center sill, and parallel to the top chords and side sills. Unless otherwise noted, vertical, or upward and downward, are terms that use top of rail, TOR, as a datum. In a Cartesian frame of reference, this may be defined as the z-axis, or z-direction. In the context of the railroad car truck as a whole, the term lateral, or laterally outboard, or transverse, or transversely outboard refer to a distance or orientation relative to the longitudinal centerline of the railroad car truck, or of the centerline of a centerplate at a truck center. In a Cartesian frame of reference this may be referred to as the y-axis or y-direction. Given that the railroad car truck may tend to have both longitudinal and transverse axes of symmetry, a description of one half of the truck may generally also be intended to describe the other half as well, allowing for differences between right hand and left hand parts. Pitching motion is angular motion about a horizontal axis perpendicular to the longitudinal direction (i.e., rotation about an axis extending in the y-direction). Yawing is angular motion about a vertical or z-axis. Roll is angular motion about the longitudinal, or x-axis. In this description, the abbreviation kpsi, if used, stands for thousands of pounds per square inch. To the extent that this specification or the accompanying illustrations may refer to standards of the Association of American Railroads (AAR), such as to AAR plate sizes, those references are to be understood as at the earliest date of priority to which this application is entitled. Unless otherwise noted, it may be understood that the railroad cars described herein are of welded steel construction.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GWR and the "70 Ton Special" low profile truck sometimes used for autorack cars. In the context of trucks, a "wheelset" includes an axle and a pair of steel wheels mounted at opposite ends of the axle.

This application refers to friction dampers, or damper wedges, for railroad car trucks, and multiple friction damper systems. There are several types of damper arrangements, some being shown at pp. 715-716 of the 1997 *Car and Locomotive Cyclopedia*, those pages being incorporated herein by reference. Double damper arrangements are shown and described US Patent Application Publication No. US 2003/0041772 A1, Mar. 6, 2003, entitled "Rail Road Freight Car With Damped Suspension", and also incorporated herein by reference. Each of the arrangements of dampers shown at pp. 715 to 716 of the 1997 *Car and Locomotive Cyclopedia* can be modified to employ a four cornered, double damper arrangement of inner and outer dampers in conformity with the principles of aspects of the present invention.

Damper wedges are discussed herein. In terms of general nomenclature, the damper wedges tend to be mounted within an angled "bolster pocket" formed in an end of the truck bolster. In cross-section, each damper wedge may then have a generally triangular shape, one side of the triangle being, or having, a bearing face; a second side which might be termed the bottom, or base, forming a spring seat; and the third side being a sloped side or hypotenuse between the other two sides. The first side may tend to have a substantially planar bearing face for vertical sliding engagement against an opposed bearing face of one of the side frame columns. The second face may not be a face, as such, but rather may have the form of a socket for receiving the upper end of one of the springs of a spring group. Although the third face, or hypotenuse, may appear to be generally planar, it may tend to have a slight crown, having a radius of curvature of perhaps 60". The crown may extend along the slope and may also extend across the slope. The side faces of the damper wedges may be generally flat, and may have a coating, surface treatment, shim, or low friction pad to give a smooth sliding engagement with the sides of the bolster pocket.

During railcar operation, the side frame may tend to rotate, or pivot, through a small range of angular deflection about the end of the truck bolster to yield wheel load equalisation. The slight crown on the slope face of the damper may tend to accommodate this pivoting motion by allowing the damper to rock somewhat relative to the generally inclined face of the bolster pocket while the planar bearing face remains in planar contact with the wear plate of the side frame column. Although the slope face may have a slight crown, for the purposes of this description it will be described as the slope face or as the hypotenuse, and will be considered to be a substantially flat face as a general approximation.

In the terminology herein, damper wedges have a primary angle $\alpha$, being the included angle between (a) the sloped damper pocket face mounted to the truck bolster, and (b) the side frame column face, as seen looking from the end of the bolster toward the truck center. In some embodiments, a secondary angle $\beta$ is be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper wedge parallel to the plane of angle $\alpha$. As the suspension works in response to track perturbations, the forces acting on the secondary angle $\beta$ may tend to urge the damper wedge either inboard or outboard according to the angle chosen. The damper wedges are driven, or energized, by corner springs, or "side springs" of the spring groups. In terminology herein, the spring groups include corner springs (or snubber springs, wedge springs, or side springs) and main springs. The main springs seat under the bolster ends. The "main spring group" is accordingly a subset of the spring group that includes those springs seated under the bolster as opposed to those springs that seat under the damper wedges.

General Description of Truck Features

This description is made in the context and environment of railroad car trucks. To establish that context, FIG. 1*a* shows an example of a truck 20. Truck 20 of FIGS. 1*a* to 1*d* is intended to be generic, and may have different pendulum lengths, spring stiffnesses, spring arrangements, wheelbase, and window width and height, and so on. That is, truck 20 may tend to have a wheelbase in the range of 60 inches to 75 inches. As discussed below, it has a spring group having a vertical spring rate, and a four cornered damper group that has primary and secondary angles on the damper wedges. Truck 20 may have a 3×3 spring group arrangement, a 5×3 spring group arrangement, a 3:2:3 spring group arrangement, a 2×4 spring group arrangement, or such other as may be. While either truck may be suitable for a variety of general purpose uses, truck 20 may be optimized for carrying relatively low density, high value lading, such as automobiles or consumer products, for example, for carrying denser semi-finished industrial goods, such as might be carried in railroad freight cars for transporting rolls of paper; or for carrying dense liquid or aggregate materials such as coal, ballast, grains, flour, potash, liquid petro-chemicals, and so on. Truck 20 is thus intended to be symbolic of a wide range of truck types. Truck 20 is symmetrical about its longitudinal (x-z plane) and transverse, or lateral (y-z plane) centerline planes. Where reference is made to a side frame, it will be understood that the truck has first and second side frames, first and second spring groups, and so on.

Truck 20 has a truck bolster 24 and side frames 26. Each side frame 26 has a generally rectangular side frame window 28 that accommodates one of the ends 30 of the bolster 24. The upper boundary of window 28 is defined by the side frame arch, or compression member identified as top chord member 32, and the bottom of window 28 is defined by a tension member identified as bottom chord 34. The fore and aft vertical sides of window 28 are defined by side frame columns 36. The ends of the tension member sweep up to meet the compression member. At each of the swept-up ends of side frame 26 there are side frame pedestal fittings, or pedestal seats 38. Each pedestal seat 38 accommodates an upper fitting. The upper fitting may be a flat plate seat, or it may have a curvature. The fitting may be termed a rocker or a seat, depending on context, as described and discussed below. This upper fitting, whichever it may be, is indicated generically as 40. Fitting 40 which may be called the "seat", engages, or is engaged by, a mating fitting 42 of the upper surface of a bearing adapter 44. Fitting 42 may be the rocker that engages the "seat" of fitting 40, or the roles of seat and rocker may be reversed. Bearing adapter 44 engages, i.e., sits on, a bearing 46 mounted on one of the ends of one of the axles 48 of the truck adjacent one of the wheels 50. The wheelset includes axle 48 and wheels 50 mounted at either end thereof. Bearing 46 may be, and as shown is, a sealed roller bearing. Sealed roller bearings of standard sizes are widely used in North American practice. A fitting 40 is located in each of the fore and aft pedestal fittings 38, the fittings 40 being longitudinally aligned so side frame 26 can swing sideways relative to the truck's rolling direction.

The relationship of the mating fittings 40 and 42 is described below in relation to the illustrations of FIGS. 4*a*-4*e*. The relationship of these fittings determines part of the overall relationship between an end of one of the axles 48 of one of the wheelsets and the side frame pedestal. That is, in determining the overall response, the degrees of freedom of the mounting of the axle end in the side frame pedestal involve a dynamic interface across an assembly of parts, such as may be termed a wheelset to side frame interface assembly, that may include the bearing, the bearing adapter, an elastomeric pad, if used, a rocker if used, and the pedestal seat mounted in the roof of the side frame pedestal, whether cast, machined, or fabricated and installed as a separate part. Several different embodiments of this wheelset to side frame interface assembly are possible. To the extent that bearing 46 has a single degree of freedom, namely rotation about the wheel shaft axis, analysis of the assembly can be focused on the bearing to pedestal seat interface assembly, or on the bearing adapter to pedestal seat interface assembly. For the purposes of this description, items 40 and 42 are intended generically to represent the combination of features of a bearing adapter and pedestal seat assembly defining the interface between the roof of the side frame pedestal and the bearing adapter, and the six degrees of freedom of motion at that interface, namely vertical, longitudinal and transverse translation (i.e., translation in the z, x, and y directions) and pitching, rolling, and yawing (i.e., rotational motion about the y, x, and z axes respectively) in response to dynamic inputs.

The bottom chord or tension member of side frame 26 may have a basket plate, or lower spring seat 52 rigidly mounted thereto. Although truck 20 may be free of unsprung lateral cross-bracing, whether in the nature of a transom or lateral rods, in the event that truck 20 is taken to represent a "swing motion" truck with a transom or other cross bracing, the lower rocker platform of spring seat 52 may be mounted on a rocker, to permit lateral rocking relative to side frame 26. Spring seat 52 may have retainers for engaging the springs of a spring set, or spring group 54, sometimes referred to as the "main spring group", 56, whether internal bosses or a peripheral lip, for discouraging the escape of the bottom ends of the springs. The spring group 56, is captured between the distal end 30 of bolster 24 and spring seat 52, being placed under compression by the weight of the rail car body and lading that bears upon bolster 24 from above.

Bolster 24 has double, inboard and outboard, bolster pockets 60, 62 on each face of the bolster at the outboard end (i.e., for a total of 8 bolster pockets per bolster, 4 at each end). Bolster 24 is symmetrical about the central longitudinal vertical plane of the bolster (i.e., cross-wise relative to the truck generally) and symmetrical about the vertical mid-span section of the bolster (i.e., the longitudinal plane of symmetry of the truck generally, coinciding with the railcar longitudinal center line). Each face of each end 30 of bolster 24 has a pair of spaced apart bolster pockets 60, 62 for receiving damper wedges 64, 66, 68, 70, respectively. Pocket 60 is laterally inboard of pocket 62 relative to side frame 26 of truck 20 more generally. Wear plate inserts, e.g., of specially hardened, machined material, can be mounted in pockets 60, 62 along the angled damper wedge faces.

As can be seen, and as is discussed in greater detail below, damper wedges 64, 66, 68, 70 have a primary angle, a as measured between vertical and the angled trailing vertex of the larger face. For the embodiments discussed herein, primary angle $\alpha$ may tend to lie in the range of 30-50 degrees, possibly about 40-45 degrees. This same angle $\alpha$ is matched by the facing surface of the bolster pocket, be it 60 or 62. A secondary angle $\beta$ gives the inboard, (or outboard), rake of the sloped surface of the damper wedge. The true rake angle can be seen by sighting along plane of the sloped face and measuring the angle between the sloped face and the planar outboard face. The rake angle is the complement of the angle so measured. The rake angle may tend to be greater than 5 degrees, may lie in the range of 5 to 20 degrees, and is preferably about 10 to 15 degrees. A modest rake angle may be desirable.

When the truck suspension works in response to track perturbations, the damper wedges may tend to work in their pockets. The rake angles yield a component of force tending to bias the inboard face of outboard wedge 68 (or 70) inboard against the opposing inboard face of bolster pocket 62. Similarly, the outboard face of wedge 64 (or 66) may tend to be biased toward the outboard planar face of inboard bolster pocket 60. These inboard and outboard faces of the bolster pockets may be lined with a low friction surface pad, or may be left as a metal surface, as shown. The left hand and right hand biases of the wedges may tend to keep them closer together, and, by keeping them against the planar facing walls, may tend to aid in discouraging twisting of the dampers in the respective pockets.

Bolster 24 includes a middle land 98 between pockets 60, 62, against which spring 96 works. Middle land 98 is such as might be found in a spring group that is three (or more)

coils wide. However, whether two, three, or more coils wide, and whether employing a central land or no central land, bolster pockets can have both primary and secondary angles as illustrated, with or without wear inserts. Where a central land, e.g., land 98, separates two damper pockets, the opposing side frame column wear plates need not be monolithic. That is, two wear plate regions could be provided, one opposite each of the inboard and outboard dampers, presenting planar surfaces against which the dampers can bear. The normal vectors of those regions may be parallel, the surfaces may be co-planar and perpendicular to the long axis of the side frame, and may present a clear, un-interrupted surface to the friction faces of the dampers.

As noted above, bolster pockets 60, 62 accommodate fore and aft pairs of first and second, laterally inboard and laterally outboard friction damper wedges 64, 66 and 68, 70, respectively. Each bolster pocket 60, 62 has an inclined face, or damper seat 72, that mates with a similarly inclined hypotenuse face 74 of the damper wedge, 64, 66, 68 and 70. Wedges 64, 66 each sit over a first, inboard corner spring 76, 78, and wedges 68, 70 each sit over a second, outboard corner spring 80, 82. Angled faces 74 of wedges 64, 66 and 68, 70 (discussed in greater detail below) ride against the angled faces of respective seats 72. Middle end spring 96 bears on the underside of a land 98 located intermediate bolster pockets 60 and 62. The top ends of the central row of springs, 100, seat under the main central portion 102 of the end of bolster 24. In this four corner arrangement, each damper is individually sprung by one or another of the springs in the spring group.

The static compression of the springs under the weight of the car body and lading tends to act as a spring loading to bias the damper to act along the slope of the bolster pocket to force the friction surface against the side frame. Friction damping is provided when the vertical sliding faces 90 of the friction damper wedges 64, 66 and 68, 70 ride up and down on friction wear plates 92 mounted to the inwardly facing surfaces of side frame columns 36. In this way the kinetic energy of the motion is, in some measure, converted through friction to heat. This friction may tend to damp out the motion of the bolster relative to the side frames. When a lateral perturbation is passed to wheels 50 by the rails, rigid axles 48 may tend to cause both side frames 26 to deflect in the same direction. The reaction of side frames 26 is to swing, like pendula, on the upper rockers. The weight of the pendulum and the reactive force arising from the twisting of the springs may then tend to urge the side frames back to their initial position. The tendency to oscillate harmonically due to track perturbations may tend to be damped out by the friction of the dampers on the wear plates 92.

As compared to a bolster with single dampers, such as may be mounted on the side frame centerline, the use of doubled dampers such as spaced apart pairs of dampers 64, 68 may tend to give a larger moment arm, for resisting parallelogram deformation of truck 20 more generally. Use of doubled dampers yields a greater restorative "squaring" force to allow the truck to flex, i.e., deflect, in response to perturbations, but then to return the truck resiliently to a square orientation than for a single damper alone with the restorative bias, namely the squaring force, increasing with increasing deflection. That is, in parallelogram deformation, or lozenging, the differential compression of one diagonal pair of springs (e.g., inboard spring 76 and outboard spring 82 may be more pronouncedly compressed) relative to the other diagonal pair of springs (e.g., inboard spring 78 and outboard spring 80 may be less pronouncedly compressed than springs 76 and 82) tends to yield a restorative moment couple acting on the side frame wear plates. This moment couple tends to rotate the side frame in a direction to square the truck, (that is, in a position in which the bolster is perpendicular, or "square", to the side frames). As such, the truck is able to flex, and when it flexes the dampers co-operate in acting as biased members working between the bolster and the side frames to resist parallelogram, or lozenging, deformation of the side frame relative to the truck bolster and to urge the truck back to the non-deflected position.

The foregoing explanation has been given in the context of truck 20 which has a spring group 54 that has three rows facing side frame columns 36. The restoring moment in such a case would be $M_R$, the moment couple of one pair of diagonally opposed damper springs at the corner of the spring group, minus the moment couple of the other diagonally opposed pair, and, given the sloped back of the damper wedges, the restorative moment is a function of $k_c$, the vertical spring constant of the coil upon which the damper sits and is biased.

Although the embodiment shown is 3×3, there are various possible arrangements of spring groups 2×4, 3×3, 3:2:3 or 3×5 group. As shown dampers may be mounted over each of four corner positions. The coil groups can be of unequal stiffness if inner coils are used in some springs and not in others, or if springs of differing spring constant are used. Moreover, the damper springs may have a different undeflected length than the main spring coils. That is, the damper springs may be longer than the main spring coils. Thus, the pre-load deflection of the damper springs will be greater than the pre-load deflection of the main springs. This will be true in both the light car (i.e., empty) and fully laded car conditions. Accordingly, the proportionate difference (i.e., the percentage change) in energizing spring force in the damper springs will have a correspondingly smaller proportionate variation between the top and bottom of the stroke of the friction wedge over its full amplitude as compared to the main springs. In the example, the free height of corner springs 76, 78, 80 and 82 is 11" whereas the main springs are AAR standard D5 springs having a free height of 10.25".

An enhanced tendency to encourage flexibly restorative squareness at the bolster to side frame interface (i.e., through the use of four cornered damper groups) tends to reduce reliance on squareness at the pedestal to wheelset axle interface. This, in turn, may tend to provide an opportunity to employ a torsionally compliant (about the vertical axis) axle to pedestal interface assembly, and to permit a measure of self steering.

The bearing plate, namely side frame column wear plate 92 (FIG. 1*a*) is significantly wider than the through thickness of the side frames more generally, as measured, for example, at the pedestals, and may tend to be wider than has been conventionally common. This additional width corresponds to the additional overall damper span width measured fully across the damper pairs, plus lateral travel as noted above, typically allowing 1½ (+/−) inches of lateral travel of the bolster relative to the side frame to either side of the undeflected central position. That is, rather than having the width of one coil, plus allowance for travel, plate 92 may have the width of three coils, plus allowance to accommodate 1½ (+/−) inches of travel to either side for a total, double amplitude travel of 3" (+/−). Bolster 24 has inboard and outboard gibs 106, 108 respectively, that bound the lateral motion of bolster 24 relative to side frame columns 36. This motion allowance may be in the range of +/−1⅛ to 1¾ in., and may be in the range of 1 3/16 to 1 9/16 in., and can be set, for example, at 1½ in. or 1¼ in. of lateral travel to either side of a neutral, or centered, position when the side frame is undeflected.

The lower ends of the springs of the entire spring group, identified generally as 58, seat in lower spring seat 52. Lower spring seat 52 may be laid out as a tray with an upturned rectangular peripheral lip. Although truck 20 employs a spring group in a 3×3 arrangement, this is intended to be generic, and to represent a range of variations. They may represent 3×5, 2×4, 3:2:3 or 2:3:2 arrangement, or some other, and may include a hydraulic snubber, or such other arrangement of springs may be appropriate for the given service for the railcar for which the truck is intended.

Damper Wedges

The inventor has noted that how the friction pad interacts with the side frame column wear plate changes the ride quality of the truck. To obtain the designed-for ride quality, it is helpful if the non-metallic wear surfaces of the non-metallic wear pads wear relatively evenly, rather than wearing disproportionately along one edge.

This wear is sensitive to the location of the contact point on the sloped side of the damper wedge to the inclined face of the bolster pocket. During operation, the damper wedges tend to move slightly in the pockets, as when the side frames yaw, pitch, and roll relative to the bolster. These deflections may appear to be small. In existing trucks the crown radius on the back of the damper is very slight. It may have an effective radius on the order of 60 inches. In one type of truck it is known to be about 40 inches, and is cylindrical to produce line contact, rather than point contact. Considering, by contrast, point contact, the crown radius allows the damper wedge to find its own fit in the damper pocket, and to tolerate relative motion of the side frame in yaw, pitch, and roll with less tendency toward jamming or binding. The use of a 60 inch radius curvature was formerly considered acceptable for this purpose of allowing the damper wedge to find its own equilibrium position. Over time, in use a wear patch, which may also be called a contact patch, 182 may form, where the back of the damper wedge has repeatedly contacted the face of the bolster pocket. This contact patch tends to wear as the faces are repeatedly placed in compression against each other. The contact patch reflects the two degrees of freedom of the rocking surface. That is, the contact patch has an extent along the primary angle slope of the back of the damper wedge and also transversely along the secondary angle bias. There will be a similar wear patch in the bolster pocket. The wear of the non-metallic wear surface of the friction pad may tend to be influenced by the forces it sees, and the forces experienced by the non-metallic wear surface of the friction pad appear to correlate to the location and size of this 2 degree of freedom contact patch.

FIGS. 2*a* to 2*d* and FIGS. 3*a*-3*i*

The damper wedge is indicated as 120. Although a right-hand damper wedge is shown, a left-hand damper wedge is of the same structure, and is a mirror image of the right hand damper wedge. Accordingly, the description of the right hand damper wedge will be understood to describe both parts, allowing for opposite-handedness. In that regard, damper wedge 120 is intended to be a generic representation of left hand and right hand damper wedges 64 and 68.

Damper wedge 120 has a body 122. Body 122 may be, and in the embodiment shown is, made from a relatively common material, such as a ductile iron, cast steel, or cast iron. When seen in side view, it has a generally triangular shape. There is a first face or portion or member 124, which extends vertically; a second face or member, or portion 126 that extends horizontally, and a third member or face or portion 128 that extends generally on a slope, and may be thought of as being the hypotenuse member between member 124 and 126, the three parts thereby combining to form the generally triangular shape noted. Damper wedge 120 also has a first end face or end wall 132 and a second end face of end wall 134. In this instance, the first end face 132 is the larger end face (i.e., FIG. 3*d*) and the second end face 134 is the smaller end face (FIG. 3*c*). Damper wedge 120 has a primary angle, α, (alpha) seen in side view in FIG. 3*c*. In the embodiment illustrated, angle α is the same angle α as that of the matching, or corresponding, or associated surface of the sloped face 74 of the bolster pocket, be it 60 or 62. It is possible that the two planes need not be exactly parallel, but it is convenient both for conceptual understanding and for manufacture that they be made the same. Angle α defines the primary angle of the bolster relative to the vertical plane when the damper wedge is seen in side view. Damper wedge 120 also has a secondary damper angle, β (beta). In the example illustrated, the secondary angle of damper wedge 120 is the same as the secondary angle β of the inclined surface of the bolster pocket, be it 60 or 62. It runs transversely, and defines the lateral bias of damper wedge 120 in the pocket. The true view of secondary angle β is seen by sighting along the back of damper wedge 120 in the inclined plane of primary damper angle α. This is the view seen in FIG. 3*h*. Angle beta is the angle of the tangent plane at the point of contact, identified as the Working Point, WP, discussed below, relative to the perpendicular to end walls or end faces 132, 134 in the plane of angle α. Again, it may be possible for angle β to be slightly different from that of the corresponding or associated bolster pocket, but for ease of conceptual understanding and ease of manufacture, they may generally be assumed to be the same.

Given secondary angle β, end wall or end face 132 is larger than end wall or end face 134, and damper wedge 120 is asymmetric as viewed from behind or from above. Damper wedge 120 also has a grip or hold, or lifting member, or retainer 130 that extends upwardly from first portion or first member 124, and whose form and purpose is as described below.

Damper wedge 120 may be made as a solid casting. Alternatively, damper wedge 120 may be hollow, as shown. That is, body 122 has an internal cavity 140 bounded by items 124, 126, 128, 132 and 134. Internal cavity 140 may be, and as illustrated is, divided into two sub-compartments or chambers 136, 138 by a gusset, or partition, or web 150. Web 150 may have a central opening or hole 146. Each of end faces 132 and 134 may have a triangular, or generally triangular opening, 142, 144 respectively.

Looking at these items, the front face member, or first member 124 is planar, or generally planar, and has a rectangular or generally rectangular rim 154 that extends peripherally around a panel or web or plate or wall 152. Plate or wall 152 extends from side to side laterally between end walls 132, 134, and up and down between the forward margin of second member 126 and the forward and upward margin of third member 128. Rim 154 and wall 152 co-operate to form a socket 156 into which is mounted a wear member 160. This may be expressed differently, namely that a relief or rebate, or cavity, or accommodation is formed in first member 124 to define socket 156, with wall 152 forming the base or back of socket 156, and rim 154 forming the lip or retainer of the accommodation so formed. Wear member 160 may be, and in this instance is, a non-metallic friction pad. As may be understood, it has a non-metallic wear surface, that, in use, slides upward and downward in friction contact against side frame column wear plate 92.

Wear member 160 is shaped to conform to, i.e., seat within the outline of, peripheral retaining rim 154. As shown, this shape is generally square or rectangular. Wear member 160 may typically be molded in place or held in place with an epoxy or other bonding method. Wear member 160 has a vertical height $h_{160}$ (in the z-direction) and a transverse width $w_{160}$ (in the y-direction). It may be taken that the half height and half width locations are coincident with the half height and half width locations of socket 156.

Lifting member 130 is formed on, and protrudes or extends upwardly from, one side of the upper edge or margin 162 of rim 154. It has the shape of an upwardly extending member 164 in which a rearwardly extending finger 166 is formed by making a semi-circular accommodation or rebate 168. The installation of damper wedges in the bolster pocket can take a bit of finesse. To facilitate this process, lifting member 130 is sized to stand forwardly of the bolster pocket and upwardly proud of the outboard gib. The end of the bolster is positioned between the side frame column wear plates, when the bolster is in position a jig tool can be used to grab and lift the damper wedge in the bolster pocket while the springs are installed. The jig tool is them removed to release the lifting member, and the damper wedge sits on the springs.

Second member 126 may be, but need not necessarily be, in the form of a plate or wall 170 that has a spring seat 172 mounted to it. In the example shown, spring seat 172 is, or includes, a boss or downward protrusion 174 that is sized to sit closely within the inner diameter of the corner spring coil, or damper spring 176 of the spring group. In this discussion the annotation 176 is intended to be a generic representation. That is, damper spring 176 can be any of corner springs 76, 78, 80 or 82 identified above. For the purpose of this discussion, although damper spring 176 is referred to as a single spring, it will be understood that it could be, and in this case it is, a double coil that has both an inner coil and an outer coil. Protrusion 174 locates the spring coil axially. That portion of plate or wall 170 that extends radially away from protrusion 174 acts as an abutment or stop determining the end of travel of the upper end of the spring, and its vertical position depending on the dynamic vertical loading condition. Protrusion 174 may be understood as a cylindrical boss having a vertical centerline that, as installed, is the same as the vertical centerline of damper spring 176, indicated as $CL_{176}$. As might also be implicit from the previous discussion, second member 126 is square to (i.e., perpendicular to first member 124.

Third member 128 is the sloped member. It is nominally on the slope according to primary angle alpha, but it has a crown. The location of the tangent point of that crown that is the neutral contact point when the car is at rest is defined as the Working Point, WP. The formed steel wall whose outer surface defines the working surface 200 of third portion 128 is identified as 180. Inside body 122, the internal web 150 extends from front wall 152 to rear wall 180, and from both of them to bottom plate or bottom wall 170. In this position internal web 150 reinforces all three members. Web 150 is taken as having a web thickness $t_{150}$, indicated in FIG. 3*a*. In the embodiment shown, wall 180 lies above centerline $CL_{176}$ and in the same vertical plane as the Working Point, WP. That plane, notionally indicated as 190, is defined as the plane in which lies the spring centerline $CL_{176}$, and a normal vector to the friction surface of the non-metallic friction member, namely pad 160, i.e., a vector normal to wall 152. That is, the plane is square to the friction member. It is referred to as the "datum plane". In the particular example shown, the datum plane may also be the plane mid-way between the first and second end faces of body 122. For the purposes of this description, there are three ranges to be considered. There is a broad range, such as might be termed a central region, or central zone of surface 200 adjacent to and containing plane 190 which would include material lying in plane 190 and in the region of surface 200 that is within two web thicknesses $t_{150}$ of web centerline $CL_{176}$ in the cross-wise or y-direction. There is a narrower range, which lies within the projected thickness of web 150. Finally there is a narrow range, in which the rolling contact point lies in plane 190, or within ⅛ inch to either side thereof, or such that the contact surface of the male and female members in rolling point contact under load lies on, or over, plane 190. In such circumstances, a person of skill would reasonably describe Working Point WP as lying in, or lying approximately in, plane 190. The Working Point, WP lies in the tangent plane of inclined surface 200. That is, assuming that Working Point, WP, is in the Datum Plane, and assuming that the curvature of surface 200 is spherical for simplicity, the tangent plane is constructed to passes through Working Point WP inclined according to primary angle $\alpha$ and according to secondary angle $\beta$. In the embodiment illustrated that tangent plane would in the most conceptually simple example also be the plane of the sloped face of the bolster pocket. Inasmuch as this is a rolling point contact interface, the adjacent regions of surface 200 are located shy of that tangent plane, and the normal to the tangent plane at the point of contact defines a radius of the spherical surface. The center of curvature at the origin of that radius will lie to one side of datum plane 190, the radius being skewed therefrom by the $\beta$ angle as taken in the plane of the $\alpha$ angle. The location of WP may be taken as being within 1" radius of datum point DP as measured in surface 200. Expressed differently, in terms scaled to the size of damper wedge 120 itself, WP is within ¼ of the width of damper wedge 120 of DP; or, expressed differently again, WP is within ¼ of the height of non-metallic wear pad 160 of DP. In some embodiments when the parts are in rolling point contact under load, it is within the width of the contact point of datum plane 190.

In terms of physical operation, the forces applied to body 122 include the normal force to side frame column wear plate 92, the friction force in the up or down direction in the plane of wear member 92, the vertical reaction force in the spring seat, and the angled reaction force applied to sloped surface 200. When truck 20 is at rest, on level track, in equilibrium, the point of application of the reaction on the sloped surface is at the Working Point, WP. During dynamic operation, as the bolster moves up and down relative to the side frame column and as the side frame pitches, yaws, and sways, the actual instantaneous contact point diverges from nominal working point WP. The range of motion of the side frame in pitch is small, perhaps of the order of +/−2 degrees. The range of deflection in yaw is also small, being of the order of +/−3 degrees. The range of deflection in roll is also small, being, likewise of the order of +/−3 degrees. The squirming of damper wedge 120 during operation occurs within these ranges, and produces a "wear patch", which may also be called a "contact patch", 182 on the sloped surface 200 of damper wedge 120 where rolling contact actually occurs, and forms a worn area on both surface 200 and on the sloped contact surface of the bolster pocket. Contact within the wear patch varies in a random, or largely random, manner as the truck moves, the track perturbations being assumed to be an input white noise function over time. The contact patch is a feature of the two-degree of freedom contact relationship of damper wedge 120 and bolster pocket 60 (or 62, as may be) extends both along the curvature of the sloped surface in the up-slope and down-slope sense, but also in the left and right cross-wise, or transverse sense, and tends to have a circular or elliptic shape associate with rolling point contact.

For a given angular deflection of side frame 26 in yaw or pitch, excursion of the instantaneous rolling point contact from Working Point WP is a function of the curvature of the back of slope surface 200. If the curvature has a large radius, such as the default 60" radius found in some existing conventional dampers, the lateral excursion in the y-direction in yaw, or the arc-wise displacement excursion in the up-slope or down-slope direction in pitch will be relatively large. Where that radius is smaller, the excursion will be smaller. In this discussion, the curvature along the slope need not be the same as the curvature across the slope. They could be different, as in an ellipse. However, it may be convenient that it be the same, such that the sloped surface is a partial spherical section of a single radius. In any case, the inventor has found that the wear patch zone becomes smaller when the radius of curvature becomes smaller, and that the performance of the damper, and damper wear life, improves where the radius is less than 45 inches. The improvement is notably better where the radius is less than 40 inches. In the inventor's observation it is helpful for the radius to be in the range of 15 to 30 inches. To that end, the embodiment illustrated is intended to represent a 20" radius, or approximately a 20 inch radius, +/−½ inch or +/−1 inch, as may be. This can be expressed differently. In the embodiment shown, the radius, $r_{182}$, of wear patch 182 is 2 inches or less. Expressed in parametric terms, the radius of wear patch 182 is less than half the width of damper wedge 120. Alternatively, the radius of wear patch 182 is less than 10% of the radius of curvature of surface 200. In the event that the curvatures had different radii to produce an ellipse having a minor axis and a major axis, those axes would replace radius $r_{182}$.

As above, in the example shown, surface 200 is formed on a curvature. Looking at FIG. 3*f*, the vertical axis of damper spring 176 intersects surface 200 at a slope datum point DP. The location of WP relative to DP can vary, depending on the geometry of the curvature of surface 200. The point contact of WP may be placed in the range of ⅛ to ⅝ offset rearwardly away in the x-direction from non-metallic friction member 160. In this example, the term "rearwardly" from DP also means "downslope". This offset can also be expressed in terms of the arc-length distance along surface 200 from DP. It can also be expressed as a proportion of the offset distance from the contact plane of the friction member with the side frame column wear surface, i.e., that surface being in the same plane as the front face of the non-metallic wear member. In the examples shown, that parametric range may be roughly 1/32 to 5/32 of the overall height of the surface of non-metallic wear member 160.

In one embodiment, the working point WP is offset rearwardly (i.e., downslope) in the x-direction (away from the front face non-metallic friction pad) between about ¼" and about ⅝". In one particular embodiment it is offset about 0.56", or 9/16". In taking these distances in proportion to the offset of the front face of the friction pad, the front edge of rim 154 is offset forwardly about 2⅝". Looking at FIG. 3*f*, in another embodiment, the non-metallic surface if offset from said axial centerline by a first distance, $x_1$; said working point is offset from said centerline by a second distance $x_2$; and a ratio of $x_1$:$x_2$ is in the range of one of (a) 21:2 to 21:8; and (b) 10:3 to 40:3. In one embodiment that ratio is about 5:1. In another way of expressing this, the non-metallic wear surface has an overall height $y_{160}$. In one embodiment, working point WP lies in the range of ⅜ to ⅝ of $y_{160}$ up the height of said non-metallic wear surface.

In the mechanical system described above, there is a single point rolling contact relationship established between the damper wedge sloped surface and the corresponding mating sloped surface of the bolster pocket. That same relationship can also be established by inverting the relationship such that the planar surface is the sloped surface of damper wedge 120 and the surface of curvature is the surface of the bolster pocket. That is, in a mathematical sense, it is to some extent arbitrary which surface is the male surface, and which surface is the female surface. In the further alternative, both surfaces may be formed on a curve, and one of the surfaces could be cylindrical rather than spherical. However, in the embodiments shown the mating surfaces are machined surfaces, and practicality of manufacture may lead to the flat, planar surface being formed in the bolster pocket, and the surface of curvature being formed on the smaller, lighter, less cumbersome, more easily machined damper wedge. Nonetheless, this specification is intended to encompass both possibilities as equivalents under the doctrine of equivalents.

Damper wedge 120 may provide friction damping with little or no "stick-slip" behaviour, but rather friction damping for which the co-efficients of static and dynamic friction are equal, or only differ by a small (less than about 20%, perhaps less than 10%) difference. Wedge 120 may be used in truck 20 in conjunction with a bi-directional bearing adapter as shown in FIGS. 4*a*-4*e* described herein. Wedge 120 may also be used in a four cornered damper arrangement, as in truck 20, for example. Wear member 160 may be formed of a brake lining material, and the column wear plate may be formed from a high hardness steel.

Damper wedge 120 has a footprint having a vertical extent somewhat greater than the vertical extent of sloped seat of face 74. Sloped seat of face 74 is inclined at a primary angle $\alpha$, and a secondary angle $\beta$. This allows for movement and wear. The lifting lug, of lifting member 130 is mounted on the upper margin, and is visible from above after installation.

In this embodiment, the vertical face of first portion of first member 124 of friction damper wedge 120 has a bearing surface having a co-efficient of static friction, $\mu_s$, and a co-efficient of dynamic or kinetic friction, $\mu_k$, that may tend to exhibit little or no "stick-slip" behaviour when operating against the wear surface of wear plate 92. In one embodiment, the co-efficients of friction are within 10% of each other. In another embodiment the co-efficients of friction are substantially equal and may be substantially free of stick-slip behaviour. In one embodiment, when dry, the co-efficients of friction may be in the range of 0.10 to 0.45, may be in the narrower range of 0.15 to 0.35, and may be about 0.30. Friction damper wedge 120 may have a friction face coating, or may be a bonded pad, such as 160, having these friction properties. Bonded pad 160 may be a polymeric pad or coating. In another embodiment, the co-efficients of static and dynamic friction are substantially equal. The co-efficient of dynamic friction may be in the range of 0.10 to 0.30, and may be about 0.20.

FIGS. 4*a*-4*e*

The rocking interface surface of the bearing adapter might have a crown, or a concave curvature, like a swing motion truck, by which a rolling contact on the rocker permits lateral swinging of the side frame. The bearing adapter to pedestal seat interface might also have a fore-and-aft curvature, whether a crown or a depression, and that, for a given vertical load, this crown or depression might tend to present a more or less linear resistance to deflection in the longitudinal direction, much as a spring or elastomeric pad might do.

The stiffness of a pendulum is directly proportional to the weight of the pendulum, and, for small angles of deflection, can be taken as being proportional to the angular deflection, in a geometric relationship that approximates f=kx. A pendulum may tend to maintain a general proportionality between the weight borne by the wheel and the stiffness of the self-steering mechanism as the lading increases, and thereby tend to give proportionate steering whether the car is empty or fully laden. These stiffnesses are geometric stiffnesses, rather than spring stiffnesses.

FIGS. 4*a*-4*e* show an embodiment of bearing adapter and pedestal seat assembly. Bearing adapter 44 has a lower portion 212 that seats on bearing 46 on axle 48. Bearing adapter 44 has an upper portion 214 that has a male bearing adapter interface portion 216. A mating female rocker seat interface portion 218 is mounted within the roof 220. Upper fitting 218 may be a flat planar surface. When the side frames are lowered over the wheel sets, the end reliefs, or channels 228 lying between the bearing adapter corner abutments 232 seat between the respective side frame pedestal jaws 230. With the side frames in place, bearing adapter 44 is thus captured in position with the male and female portions (216 and 218) of the adapter interface in mating engagement.

Bearing adapter 44 may have a central body portion 254 of the adapter has been trimmed to be shorter longitudinally, and the inside spacing between the corner abutment portions has been widened somewhat, to accommodate the installation of an auxiliary centering device, or centering member, or centrally biased restoring member in the nature of, for example, elastomeric bumper pads, such as those identified as resilient pads, or members 256. Members 256 may be considered a form of restorative centering element, and may also be termed "snubbers" or "bumper" pads.

Figure 5A:
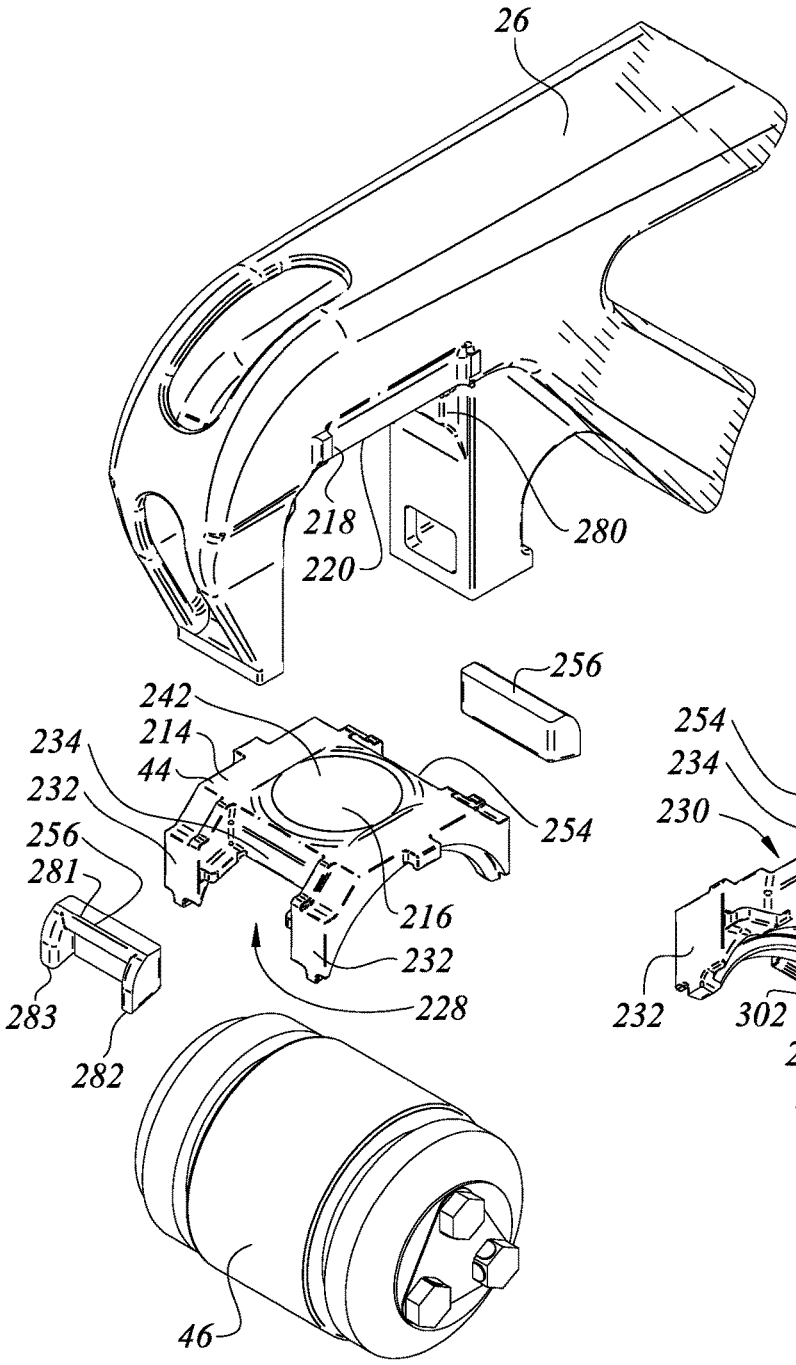
FIG. 5*a* shows an exploded isometric view of the side frame of FIG. 4*a* with the bearing, bearing adapter, and bearing adapter snubbers.
Figure 5B:
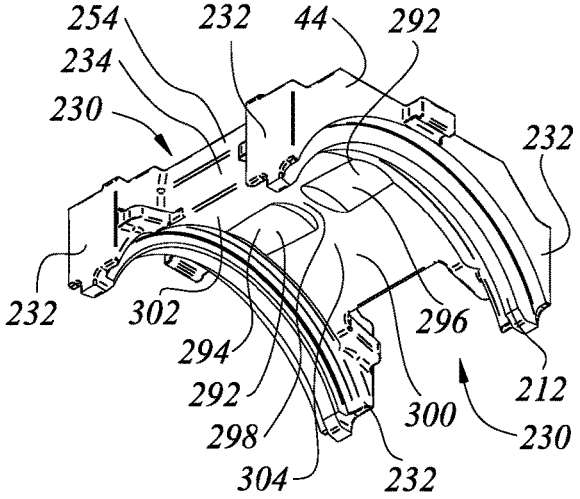
FIG. 5*b* shows the underside of the bearing adapter of FIG. 5*a;*
Figure 6A:
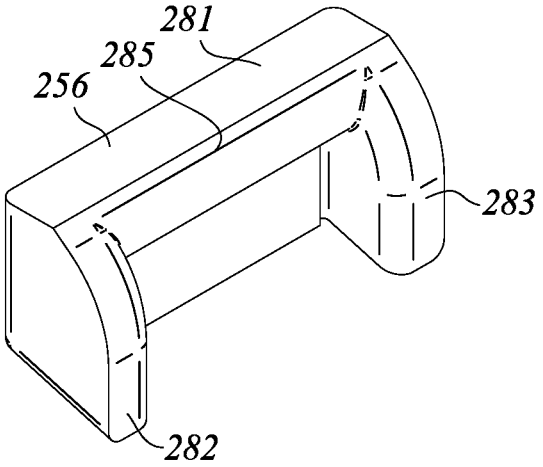
FIG. 6*a* shows an isometric view of one of the snubbers of FIG. 5*a;*
Figure 6B:
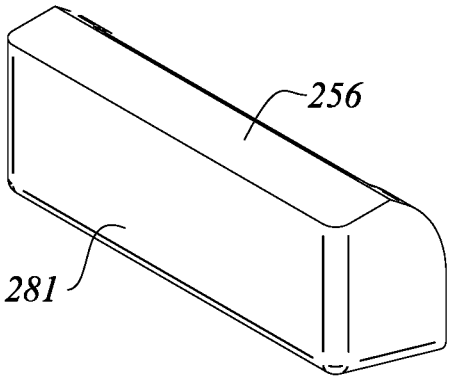
FIG. 6*b* shows an opposite isometric view of the snubber of FIG. 6*a;*
Figure 6C:
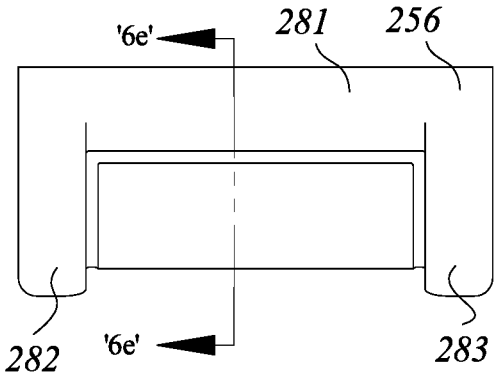
FIG. 6*c* shows a front view of the snubber of FIG. 6*a;*
Figure 6D:
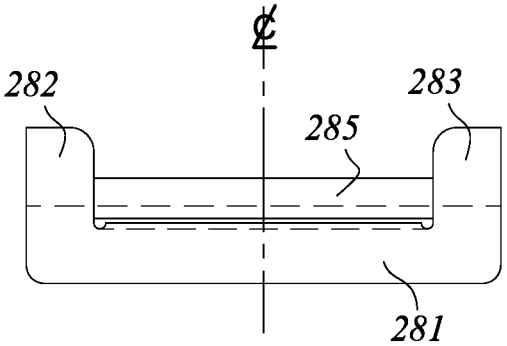
FIG. 6*d* shows a bottom view of the snubber of FIG. 6*a*.
Figure 6E:
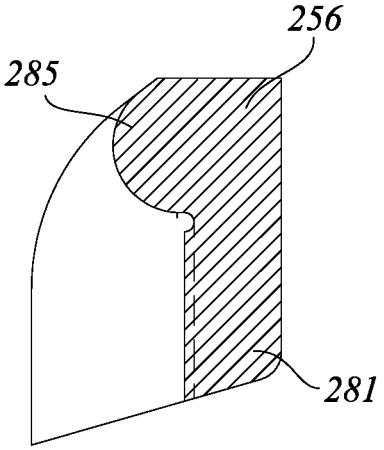
FIG. 6*e* shows a section of the snubber of FIG. 6*c* taken on section '6*e*-6*e*' of FIG. 6*c*.

As shown in FIGS. 6*a*-6*e*, resilient members 256 may have the general shape of a channel, having a central, or back, or transverse, or web portion 281, and a pair of left and right hand, flanking wing portions 282, 283. Wing portions 282 and 283 may tend to have downwardly and outwardly tending extremities that may tend to have an arcuate lower edge such as may seat over the bearing casing. The inside width of wing portions 282 and 283 may be such as to seat snugly about the sides of thrust blocks 280. A transversely extending lobate portion 285, running along the upper margin of web portion 281, may seat in a radiused rebate 284 between the upper margin of thrust blocks 280 and the end of pedestal seat fitting 40. The inner lateral edge of lobate portion 285 may tend to be chamfered, or relieved, to accommodate, and to seat next to, the end of pedestal seat 40. FIGS. 5*a* and 5*b* show views of bearing adapter 44, and elastomeric bumper pad members 256, as an assembly for insertion between bearing 46 and side frame 26.

Bearing adapter 44 may also have underside relief or grooving, 292 in the nature of a pair of laterally extending tapered lobate depressions, cavities, or reliefs 294, 296 separated by a central bridge region 298 having a deeper section and flanks that taper into reliefs 294, 296. Reliefs 294, 296 may have a major axis that runs laterally with respect to the bearing adapter itself, but, as installed, runs axially with respect to the axis of rotation of the underlying bearing. The absence of material at reliefs 294, 296 leaves a generally H-shaped footprint on the circumferential surface 300 that seats upon the outside of bearing 46, in which the two side regions, or legs, of the H form lands or pads 302, 304 joined by a relatively narrow waist, namely bridge region 298. To the extent that the undersurface of the lower portion of bearing adapter 44 conforms to an arcuate profile, such as may accommodate the bearing casing, reliefs 294, 296 may tend to run, or extend, predominantly along the apex of the profile, between the pads, or lands, that lie to either side. This configuration may tend to spread the rocker rolling contact point load into pads 302, 304 and thence into bearing 46. Bearing life may be a function of peak load in the rollers. By leaving a space between the underside of the bearing adapter and the top center of the bearing casing over the bearing races, reliefs 294, 296 may tend to prevent the vertical load being passed in a concentrated manner predominantly into the top rollers in the bearing. Instead, it may be advantageous to spread the load between several rollers in each race. This may tend to be encouraged by employing spaced apart pads or lands, such as pads 302, 304, that seat upon the bearing casing. Central bridge region 298 may seat above a section of the bearing casing under which there is no race, rather than directly over one of the races.

Male portion 216 has been formed to have a generally upwardly facing surface 242 that has both a first curvature $r_1$ to permit rocking in the longitudinal direction (FIGS. 4*d*, 4*e*), and a second curvature $r_2$ (FIGS. 4*b*, 4*c*) to permit rocking (i.e., swing motion of the side frame) in the transverse direction. Similarly, in the general case, female portion 218 has a surface having a first radius of curvature $R_1$ in the longitudinal direction, and a second radius of curvature $R_2$ in the transverse direction. The engagement of $r_1$ with $R_1$ permits longitudinal rocking motion, with resistance proportional to the weight on the wheel. That is to say, the resistance to angular deflection is proportional to weight rather than being a fixed spring constant. This may tend to yield passive self-steering in both the light car and fully laden conditions. This relationship is shown in FIGS. 4*d* and 4*e*. FIG. 4*d* shows the centered, or at rest, non-deflected position of the longitudinal rocking elements. FIG. 4*e* shows the rocking elements at their condition of maximum longitudinal deflection. FIG. 4*d* represents a local, minimum potential energy condition for the system. FIG. 4*e* represents a system in which the potential energy has been increased by virtue of the work done by force F acting longitudinally in the horizontal plane through the center of the axle and bearing, $C_B$, which will tend to yield an incremental increase in the height of the pedestal. Put differently, as the axle is urged to deflect by the force, the rocking motion may tend to raise the car, and thereby to increase its potential energy.

In general, the deflection may be measured either by the angular displacement of the axle centerline, $\theta_1$, or by the angular displacement of the rocker contact point on radius $r_1$, shown as $\theta_2$. End face 234 of bearing adapter 44 is inclined at an angle 11 from the vertical. A typical range for $\eta$ might be about 3 degrees of arc. A typical maximum value of $\delta_{long}$ may be about +/−3/16" to either side of the vertical, at rest, center line.

Figure 4C:
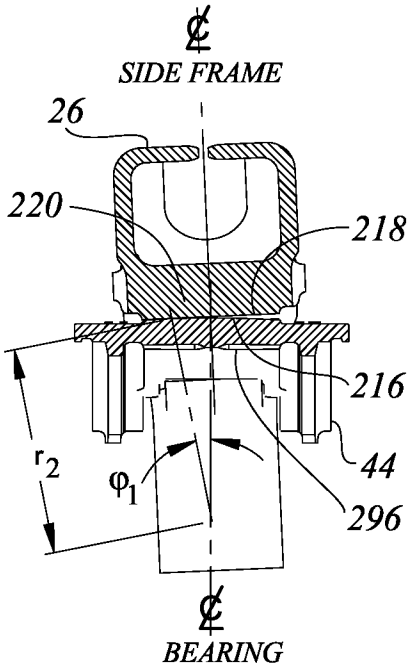
FIG. 4*c* shows the section of FIG. 4*b* as deflected laterally in a swinging motion.
Figure 4B:
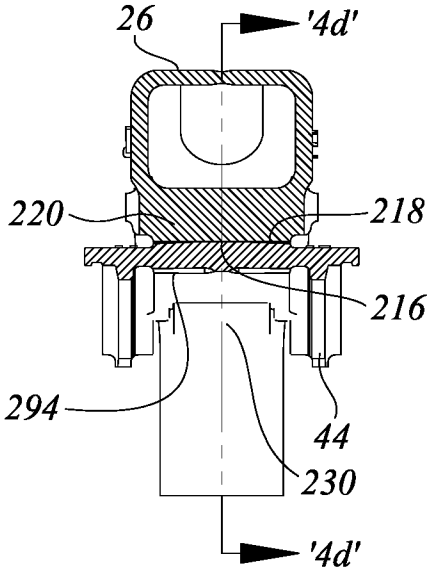
FIG. 4*b* is a sectional view through the side frame on section '4*b*-4*b*' of FIG. 4*a;*

Similarly, as shown in FIGS. 4*b* and 4*c*, in the transverse direction, the engagement of $r_2$ with $R_2$ may tend to permit lateral rocking motion, as may be in the manner of a swing motion truck. FIG. 4*b* shows a centered, at rest, minimum potential energy position of the lateral rocking system. FIG. 4*c* shows the same system in a laterally deflected condition. In this instance $\delta_2$ is roughly $(L_{pendulum}-r_2)\text{Sin}\,\varphi$, where, for small angles Sin $\varphi$ is approximately equal to $\varphi$. $L_{pendulum}$ may be taken as the at rest difference in height between the center of the bottom spring seat, 52, and the contact interface between the male and female portions 216 and 218.

This bearing adapter to pedestal seat interface assembly is biased by gravity acting on the pendulum toward a central, or "at rest" position, where there is a local minimum of the potential energy in the system. The fully deflected position shown in FIG. 4*c* may correspond to a deflection from vertical of the order of less than 10 degrees (and preferably less than 5 degrees) to either side of center, the actual maximum being determined by the spacing of gibs 106 and 108 relative to plate 92. Although in general $R_1$ and $R_2$ may differ, so the female surface is an outside section of a torus, it may be desirable, for $R_1$ and $R_2$ to be the same, i.e., so that the bearing surface of the female fitting is formed as a portion of a spherical surface, having neither a major nor a minor axis, but merely being formed on a spherical radius. $R_1$ and $R_2$ give a self-centering tendency. That tendency may be quite gentle. Although it is possible for $r_1$ and $r_2$ to be the same, such that the crowned surface of the bearing adapter (or the pedestal seat, if the relationship is inverted) is a portion of a spherical surface, in the general case $r_1$ and $r_2$ may be different. It may also be noted that, provided the system may tend to return to a local minimum energy state (i.e., that is self-restorative in normal operation) in the limit either or both of $R_1$ and $R_2$ may be infinitely large such that either a cylindrical section is formed or, when both are infinitely large, a planar surface may be formed. In the further alternative, it may be that $r_1=r_2$, and $R_1=R_2$. In one embodiment $r_1$ may be the same as $r_2$, and may be about 40 inches (+/−5") and $R_1$ may the same as $R_2$, and both may be infinite such that the female surface is planar.

The radius of curvature of the male longitudinal rocker, $r_1$, may be less than 60 inches, and may lie in the range of 5 to 50 inches, may lie in the range of about 40 inches. $R_1$ may be infinite, or may be less than 100 inches, and may be in the range of 25 to 60 inches, or in the narrower range of 30 to 40 inches, depending on the radius of $r_1$. The radius of curvature of the male lateral rocker, $r_2$, may be between 30 and 50 inches, and may be about 40 inches as in the embodiment shown. $R_2$ may be infinite, such that the plate is flat, or, alternatively it may be about 60 inches. Where a flat female rocker surface is used, and a male spherical surface is used, the male radius of curvature may be in the range of about 20 to about 50 in., and may lie in the narrower range of 30 to 40 in. Many combinations are possible, depending on loading, intended use, and rocker materials. In each case the mating male and female rocker surfaces may tend to be chosen to yield a physically reasonable pairing in terms of expected loading, anticipated load history, and operational life. These may vary.

The male and female surfaces may be inverted, such that the female engagement surface is formed on the bearing adapter, and the male engagement surface is formed on the pedestal seat. One of the mating parts or surfaces is part of the bearing adapter, and another is part of the pedestal.

The rocking assembly at the wheelset to side frame interface to tends to maintain itself in a centered condition. There is a spatial relationship of the assembly formed by (a) the bearing adapter, for example, bearing adapter 44; (b) the centering members, such as, for example, resilient members 256; and (c) the pedestal jaw thrust blocks, 280. When resilient member 256 is in place, bearing adapter 44; may tend to be centered relative to jaws or thrust blocks 280. As installed, the snubber (member 256) seats closely about the pedestal jaw thrust lug, and may seat next to the bearing adapter end wall and between the bearing adapter corner abutments in a slight interference fit. The snubber is sandwiched between, and establishes the spaced relative position of, the thrust lug and the bearing adapter; and provides an initial central positioning of the mating rocker elements as well as providing a restorative bias. Although bearing adapter 44 may still rock relative to side frame 26, such rocking may tend to deform (typically, locally to compress) a portion of member 256, and, being elastic, member 256 may tend to urge bearing adapter 44 toward a central position, whether there is much weight on the rocking elements or not. Resilient member 256 may have a restorative force-deflection characteristic in the longitudinal direction that is substantially less stiff than the force deflection characteristic of the fully loaded longitudinal rocker (perhaps one to two orders of magnitude less), such that, in a fully loaded car condition, member 256 may tend not significantly to alter the rocking behaviour. In one embodiment member 256 may be made of a polyurethane.

The rolling contact surface of the bearing has a local minimum energy condition when centered under the corresponding seat, and it is preferred that the mating rolling contact surface be given a radius that may tend to encourage self centering of the male rolling contact element.

This can be expressed differently. In cylindrical polar co-ordinates, the long axis of the wheelset axle may be considered as the axial direction. There is a radial direction measured perpendicularly away from the axial direction, and there is an angular circumferential direction that is mutually perpendicular to both the axial direction, and the radial direction. There is a location on the rolling contact surface that is closer to the axis of rotation of the bearing than any other location. This defines the "rest" or local minimum potential energy equilibrium position. Since the radius of curvature of the rolling contact surface is greater than the radial length, L, between the axis of rotation of the bearing and the location of minimum radius, the radial distance, as a function of circumferential angle $\theta$ will increase to either side of the location of minimum radius (or, put alternatively, the location of minimum radial distance from the axis of rotation of the bearing lies between regions of greater radial distance). Thus the slope of the function $r(\theta)$, namely $dr/d\theta$, is zero at the minimum point, and is such that r increases at an angular displacement away from the minimum point to either side of the location of minimum potential energy. Where the surface has compound curvature, both $dr/d\theta$ and $dr/dL$ are zero at the minimum point, and are such that r increases to either side of the location of minimum energy to all sides of the location of minimum energy, and zero at that location. This may tend to be true whether the rolling contact surface on the bearing is a male surface or a female surface. The rolling contact surface has a radius of curvature, or radii of curvature, if a compound curvature is employed, that is, or are, larger than the distance from the location of minimum distance from the axis of rotation, and the rolling contact surfaces are not concentric with the axis of rotation of the bearing. Another way to express this is to note that there is a first location on the rolling contact surface of the bearing that lies radially closer to the axis of rotation of the bearing than any other location thereon. A first distance, L is defined between the axis of rotation, and that nearest location. The surface of the bearing and the surface of the pedestal seat each have a radius of curvature and mate in a male and female relationship, one radius of curvature being a male radius of curvature $r_1$, the other radius of curvature being a female radius of curvature, $R_2$, (whichever it may be). $r_1$ is greater than L, $R_2$ is greater than $r_1$, and L, $r_1$ and $R_2$ conform to the formula $L^{-1}-(r_1^{-1}-R_2^{-1})>0$, the rocker surfaces being co-operable to permit self steering.

Compound Pendulum Geometry

Figure 4A:
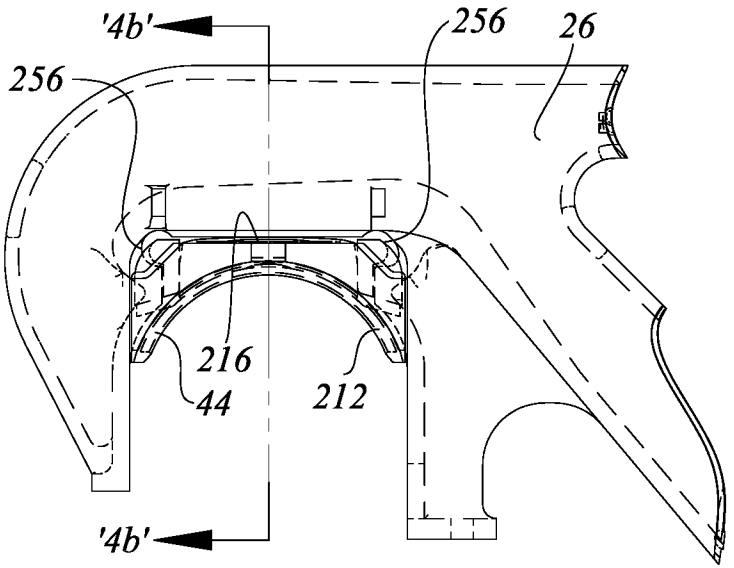
FIG. 4*a* is a side view in partial section of the end of a truck side frame of the railroad car truck of FIG. 1*a;*
Figure 4D:
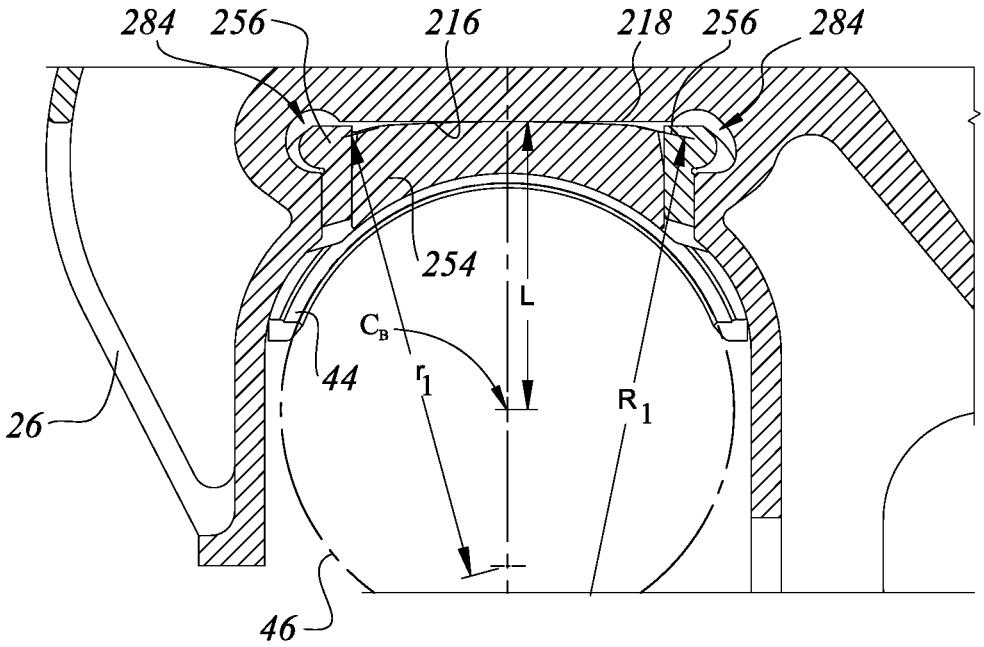
FIG. 4*d* shows a section in the longitudinal direction through the pedestal seat and bearing adapter assembly of the side frame of FIG. 4*a* on section '4*d*-4*d*' of FIG. 4*b;*
Figure 4E:
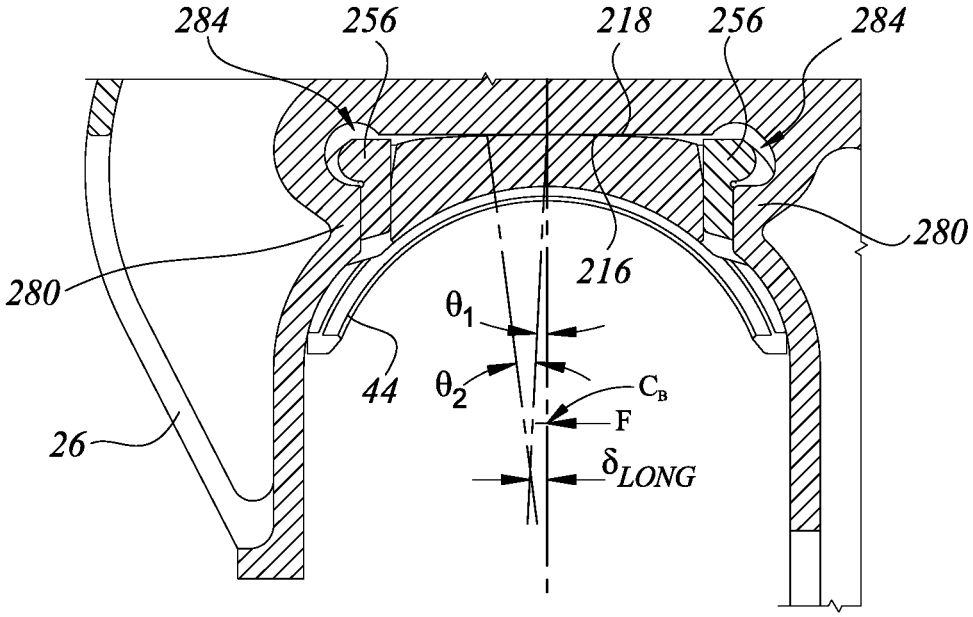
FIG. 4*e* shows the pedestal seat and bearing adapter assembly of FIG. 4*c* in a longitudinally deflected condition.

The rockers shown and described herein may employ rocking elements that define compound pendulums—that is, pendulums for which the male rocker radius is non-zero, and there is an assumption of rolling (as opposed to sliding) engagement with the female rocker. The embodiment of FIG. 4*a* shows a bi-directional compound pendulum. The performance of these pendulums may affect both lateral stiffness and self-steering on the longitudinal rocker.

The lateral stiffness of the suspension may tend to reflect the stiffness of (a) the side frame between (i) the bearing adapter and (ii) the bottom spring seat (that is, the side frames swing laterally); (b) the lateral deflection of the springs between (i) the lower spring seat and (ii) the upper spring seat mounting against the truck bolster, and (c) the moment between (i) the spring seat in the side frame and (ii) the upper spring mounting against the truck bolster. The lateral stiffness of the spring groups may be approximately ½ of the vertical spring stiffness.

A formula may be used for estimation of truck lateral stiffness:

$$k_{truck}=2\times[(k_{sideframe})^{-1}+(k_{spring\ shear})^{-1}]^{-1}$$

where $k_{sideframe}=[k_{pendulum}+k_{spring\ moment}]$ $k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

In a pendulum, the relationship of weight and deflection is roughly linear for small angles, analogous to F=kx, in a spring. A lateral constant can be defined as $k_{pendulum}=W/L$, where W is weight, and L is pendulum length. An approximate equivalent pendulum length can be defined as $L_{eq}=W/k_{pendulum}$. W is the sprung weight on the side frame. For a truck having L=15 and a 60" crown radius, $L_{eq}$ might be about 3 in. For a swing motion truck, $L_{eq}$ may be more than double this.

A formula for a longitudinal (i.e., self-steering) rocker as in FIG. 4*a*, may also be defined:

$$F/\delta_{long}=k_{long}=(W/L)[[(1/L)/(1/r_1-1/R_1)]-1]$$

Where:

$k_{long}$ is the longitudinal constant of proportionality between longitudinal force and longitudinal deflection for the rocker.

F is a unit of longitudinal force, applied at the centerline of the axle $\delta_{long}$ is a unit of longitudinal deflection of the centerline of the axle L is the distance from the centerline of the axle to the apex of male portion 216.

$R_1$ is the longitudinal radius of curvature of the female hollow in the pedestal seat 38.

$r_1$ is the longitudinal radius of curvature of the crown of the male portion 216 on the bearing adapter In this relationship, $R_1$ is greater than $r_1$, and (1/L) is greater than $[(1/r_1)-(1/R_1)]$, and, as shown in the illustrations, L is smaller than either $r_1$ or $R_1$. In some embodiments herein, the length L from the center of the axle to apex of the surface of the bearing adapter, at the central rest position may typically be about 5¾ to 6 inches (+/−), and may be in the range of 5-7 inches. Bearing adapters, pedestals, side frames, and bolsters are typically made from steel. The present inventor is of the view that the rolling contact surface may preferably be made of a tool steel, or a similar material.

In the lateral direction, an approximation for small angular deflections is:

$$k_{pendulum}=(F_2/\delta_2)=(W/L_{pend.})[[(1/L_{pend.})/((1/R_{Rocker}))-(1/R_{Seat})]+1]$$

where:

$k_{pendulum}$=the lateral stiffness of the pendulum $F_2$=the force per unit of lateral deflection applied at the bottom spring seat $\delta_2$=a unit of lateral deflection W=the weight borne by the pendulum $L_{pend.}$=the length of the pendulum, as undeflected, between the contact surface of the bearing adapter to the bottom of the pendulum at the spring seat $R_{Rocker}=r_2$=the lateral radius of curvature of the rocker surface $R_{Seat}=R_2$=the lateral radius of curvature of the rocker seat Where $R_{seat}$ and $R_{Rocker}$ are of similar magnitude, and are not unduly small relative to L, the pendulum may tend to have a relatively large lateral deflection constant. Where $R_{seat}$ is large compared to L or $R_{Rocker}$, or both, and can be approximated as infinite (i.e., a flat surface), this formula simplifies to:

$$k_{pendulum}=(F_{lateral}/\delta_{lateral})=(W/L_{pend.})[(R_{Rocker}/L_{pendulum})+1]$$

Using this number in the denominator, and the design weight in the numerator yields an equivalent pendulum length, $L_{eq.}=W/k_{pendulum}$ The truck may be free of lateral unsprung bracing, whether in terms of a transom, laterally extending parallel rods, or diagonally criss-crossing frame bracing or other unsprung stiffeners. In those embodiments the trucks may have four cornered damper groups driven by each spring group.

Friction Surfaces

As explained in WO 2005 005 219 dynamic response may be quite subtle. It may be desirable to supplant a physically locked relationship with a relationship that allows the truck to flex in a non-square manner, subject to a bias tending to return the truck to its squared position such as may be obtained by employing the larger resistive moment couple of doubled dampers as compared to single dampers. While use of laterally soft rockers, dampers with reduced stick slip behaviour, four-cornered damper arrangements, and self-steering may all be helpful in their own right, it appears that they may also be inter-related in a subtle and unexpected manner. Self steering may function better where there is a reduced tendency to stick slip behaviour in the dampers. Lateral rocking in the swing motion manner may also function better where the dampers have a reduced tendency to stick slip behaviour. Lateral rocking in the swing motion manner may tend to work better where the dampers are mounted in a four cornered arrangement. Counter-intuitively, truck hunting may not worsen significantly when the rigidly locked relationship of a transom or frame brace is replaced by four cornered dampers (apparently making the truck softer, rather than stiffer), and where the dampers are less prone to stick slip behaviour. The combined effect of these features may be surprisingly interlinked.

As described herein, there is a friction damping interface between the bolster and the side frames. Either the side frame columns or the damper (or both) may have a low or controlled friction bearing surface, that may include a hardened wear plate, that may be replaceable if worn or broken, or that may include a consumable coating or shoe, or pad. That bearing face of the motion calming, friction damping element may be obtained by treating the surface to yield desired co-efficients of static and dynamic friction whether by application of a surface coating, and insert, a pad, a brake shoe or brake lining, or other treatment. Such a shoe or lining may have a polymer based or composite matrix, loaded with a mixture of metal or other particles of materials to yield a specified friction performance.

That friction surface may, when employed in combination with the opposed bearing surface, have a co-efficient of static friction, $\mu_s$, and a co-efficient of dynamic or kinetic friction, $\mu_k$. The co-efficients may vary with environmental conditions. For the purposes of this description, the friction co-efficients will be taken as being considered on a dry day condition at 70 F. In one embodiment, when dry, the co-efficients of friction may be in the range of 0.15 to 0.45, may be in the narrower range of 0.20 to 0.35, and, in one embodiment, may be about 0.30. In one embodiment that coating, or pad, may, when employed in combination with the opposed bearing surface of the side frame column, result in co-efficients of static and dynamic friction at the friction interface that are within 20%, or, more narrowly, within 10% of each other. In another embodiment, the co-efficients of static and dynamic friction are substantially equal.

A damper may be provided with a friction specific treatment, whether by coating, pad or lining on the vertical friction face. In one embodiment it may be that the co-efficients of static and dynamic friction on the friction face may be about 0.3, and may be about equal to each other.

Spring Groups

The spring groups may have a variety of spring layouts. It may be helpful to have upward and downward damping forces that are not overly dissimilar, and that may in some cases tend to be roughly equal. Frictional forces at the dampers may differ depending on whether the damper is being loaded or unloaded. The angle of the damper wedge, the co-efficients of friction, and the springing under the damper wedges can be varied. A damper wedge is being "loaded" when the bolster is moving downward in the side frame window, since the spring force is increasing, and hence the force on the damper wedge is increasing. Similarly, a damper wedge is being "unloaded" when the bolster is moving upward toward the top of the side frame window, since the force in the springs is decreasing.

The equations can be written as:

While loading $$F_d = \mu_c F_s \frac{(\mathrm{Cot}(\Phi) - \mu_s)}{(1 + (\mu_s - \mu_c)\mathrm{Cot}(\Phi) + \mu_s\mu_c)}$$

While unloading $$F_d = \mu_c F_s \frac{(\mathrm{Cot}(\Phi) - \mu_s)}{(1 + (\mu_s - \mu_c)\mathrm{Cot}(\Phi) + \mu_s\mu_c)}$$

Where: $F_d$=friction force on the side frame column $F_s$=force in the spring $\mu_s$=co-efficient of friction on the angled slope face on the bolster $\mu_c$=the co-efficient of friction against the side frame column $\phi$=the included angle between the angled face on the bolster and the friction face bearing against the column For a given angle, a friction load factor, $C_f$ can be determined as $C_f = F_d/F_s$. This load factor $C_f$ will tend to be different depending on whether the bolster is moving up or down.

In some embodiments, there may be different vertical spring rates in the empty and fully loaded conditions. To that end springs of different heights may be employed, for example, to yield two or more vertical spring rates for the entire spring group. In this way, the dynamic response in the light car condition may be different from the dynamic response in a fully loaded car, where two spring rates are used. Alternatively, if three (or more) spring rates (Outer, Inner, Inner-Inner) are used, there may be an intermediate dynamic response in a semi-loaded condition. In one embodiment, each spring group may have a first combination of springs that have a free length of at least a first height, and a second group of springs of which each spring has a free length that is less than a second height, the second height being less than the first height by a distance $\delta_1$, such that the first group of springs will have a range of compression between the first and second heights in which the spring rate of the group has a first value, namely the sum of the spring rates of the first group of springs, and a second range in which the spring rate of the group is greater, namely that of the first group plus the spring rate of at least one of the springs whose free height is less than the second height. The different spring rate regimes may yield corresponding different damping regimes.

For example, in one embodiment a car having a dead sprung weight (i.e., the weight of the car body with no lading excluding the unsprung weight below the main spring such as the side frames and wheelsets), of about 35,000 to about 55,000 lbs (+/−5000 lbs) may have spring groups of which a first portion of the springs have a free height in excess of a first height. The first height may, for example be in the range of about 9¾ to 10¼ inches. When the car sits, unladen, on its trucks, the springs compress to that first height. When the car is operated in the light car condition, that first portion of springs may tend to determine the dynamic response of the car in the vertical bounce, pitch-and-bounce, and side-to-side rocking, and may influence truck hunting behaviour. The spring rate in that first regime may be of the order of 12,000 to 22,000 lbs/in., and may be in the range of 15,000 to 20,000 lbs/in.

When the car is more heavily laden, as for example when the combination of dead and live sprung weight exceeds a threshold amount, which may correspond to a per car amount in the range of perhaps 60,000 to 100,000 lbs, (that is, 15,000 to 25,000 lbs per spring group for symmetrical loading, at rest) the springs may compress to, or past, a second height. That second height may be in the range of perhaps 8½ to 9¾ inches, for example. At this point, the sprung weight is sufficient to begin to deflect another portion of the springs in the overall spring group, which may be some or all of the remaining springs, and the spring rate constant of the combined group of the now compressed springs in this second regime may tend to be different, and larger than, the spring rate in the first regime. For example, this larger spring rate may be in the range of about 20,000-30,000 lbs/in., and may be intended to provide a dynamic response when the sum of the dead and live loads exceed the regime change threshold amount.

In various embodiments of trucks, such as truck 20, the resilient interface between each side frame and the end of the truck bolster associated therewith may include a four cornered damper wedge arrangement and a 3×3 spring group. Those groupings may have damper wedges having primary angles lying in the range of 30 to 60 degrees, or more narrowly in the range of 35 to 55 degrees, more narrowly still in the range 40 to 50 degrees, or may be chosen from the set of angles of 32, 36, 40 or 45 degrees. The damper wedges have friction modified surfaces, such as non-metallic surfaces.

The combination of damper wedges and side springs may be such as to give a spring rate under the side springs that is 20% or more of the total spring rate of the spring groups. It may be in the range of 20 to 30% of the total spring rate. In some embodiments the combination of wedges and side springs may be such as to give a total friction force for the dampers in the group, for a fully laden car, when the bolster is moving downward, that is less than 3000 lbs. In other embodiments the arithmetic sum of the upward and downward friction forces of the dampers in the group is less than 5500 lbs.

Combinations and Permutations

The features of the various figures may be mixed and matched, without departing from the spirit or scope of the invention. For the purpose of avoiding redundant description, it will be understood that the various damper wedge configurations can be used with spring groups of a 2×4, 3×3, 3:2:3, 2:3:2, 3×5 or other arrangement. Similarly, there are a large number of possible combinations and permutations of damper wedge arrangements and bearing adapter arrangements. In that light, it may be understood that the various features can be combined, without further multiplication of drawings and description.

In the various embodiments of trucks herein, the gibs may be shown mounted to the bolster inboard and outboard of the wear plates on the side frame columns. In the embodiments shown herein, the clearance between the gibs and the side plates is desirably sufficient to permit a motion allowance of at least ¾" of lateral travel of the railroad car truck bolster relative to the wheels to either side of neutral, advantageously permits greater than 1 inch of travel to either side of neutral, and may permit travel in the range of about 1 or 1⅛" to about 1⅝ or 1 9/16" to either side of neutral.

In each of the trucks shown and described herein, the overall ride quality may depend on the inter-relation of the spring group layout and physical properties, or the damper layout and properties, or both, in combination with the dynamic properties of the bearing adapter to pedestal seat interface assembly. It may be helpful for the lateral stiffness of the side frame acting as a pendulum to be less than the lateral stiffness of the spring group in shear.

The embodiments of trucks shown and described herein may vary in their suitability for different types of service. Truck performance can vary significantly based on the loading expected, the wheelbase, spring stiffnesses, spring layout, pendulum geometry, damper layout and damper geometry.

Various embodiments of the invention have been described in detail. Since changes in and or additions to the above-described best mode may be made without departing from the nature, spirit or scope of the invention, the invention is not to be limited to those details but only by the appended claims.

We claim:

1. A damper wedge for a railroad car truck, said damper wedge being formed to co-operate with a bolster pocket, wherein said damper wedge comprises:

a friction member that, in use, movably engages a wear surface of a side frame column of the railroad car truck;

said friction member having a non-metallic wear surface;

a spring seat that, in use, engages a spring of the railroad car truck; and an inclined damper wedge surface having a primary angle alpha and a secondary angle beta;

said inclined damper wedge surface having a curvature;

said curvature having a working point thereon defining a location of rolling point contact of said inclined damper wedge surface with the bolster pocket of the railroad car truck when the railroad car truck is at rest;

said spring seat having an axial centerline;

said damper wedge having a datum plane that is normal to said non-metallic wear surface and contains said axial centerline;

said axial centerline meeting said inclined damper wedge surface at an intersection point; said working point being downslope of said intersection point; and said working point being located in a central region of said inclined damper wedge surface adjacent to said datum plane.

2. The damper wedge of claim 1 wherein said curvature of said inclined damper wedge surface is a machined surface.

3. The damper wedge of claim 1 wherein said working point is offset between ⅛" and ⅝" further away from said non-metallic wear surface of said friction member than is said axial centerline.

4. The damper wedge of claim 1 wherein said working point is offset between ¼" and ¾" further away from said non-metallic wear surface of said friction member than is said axial centerline.

5. The damper wedge of claim 1 wherein said non-metallic wear surface is offset from said axial centerline by a first distance, $x_1$; said working point is offset from said axial centerline by a second distance $x_2$; and a ratio of $x_1$:$x_2$ is in the range of one of (a) 21:2 to 21:8; and (b) 10:3 to 40:3.

6. The damper wedge of claim 5 wherein the ratio is 5:1.

7. The damper wedge of claim 1 wherein said non-metallic wear surface has an overall height $y_1$ and said working point lies in the range of ⅜ to ⅝ of $y_1$ up the height of said non-metallic wear surface.

8. The damper wedge of claim 1 wherein said curvature is a compound curvature.

9. The damper wedge of claim 1 wherein said curvature of said inclined damper wedge surface is spherical.

10. The damper wedge of claim 1 wherein said curvature has a radius of curvature of less than 35 inches.

11. The damper wedge of claim 10 wherein said radius is in range of 15-30 inches.

12. The damper wedge of claim 10 wherein said radius is 20 inches, +/−½ inch.

13. The damper wedge of claim 1 wherein angle alpha is between 30 deg and 50 deg.

14. The damper wedge of claim 1 wherein angle beta is between 5 degrees and 20 deg.

15. The damper wedge of claim 1 wherein said inclined damper wedge surface has a contact patch that has a radius of less than 1 inch.

16. The damper wedge of claim 1 wherein said damper wedge has first and second end walls; said inclined damper wedge surface is located between said first and second end walls; and said datum plane is mid-way between said first and second end walls.

17. The damper wedge of claim 16 wherein said inclined damper wedge surface extends to said first and second end walls.

18. The damper wedge of claim 1 wherein said damper wedge includes an internal web extending between said inclined damper wedge surface and said friction member, and said working point is aligned with said internal web.

19. The damper wedge of claim 1 wherein said working point is along said datum plane.

20. The damper wedge of claim 1 wherein said damper wedge is at least partially hollow.

21. The damper wedge of claim 1 wherein said spring seat includes a downwardly protruding boss sized to sit co-axially within a spring of the railroad car truck.

22. The damper wedge of claim 1 in combination with a spring group of the railroad car truck, the spring group having a first damper spring mounted to co-operate with said spring seat for said damper wedge, and at least a first main spring, said first damper spring having a greater free height than does said first main spring.

23. The damper wedge of claim 1 wherein said spring seat is defined in a base wall of said damper wedge; said base wall has a width and rearwardly radiused corners, said corners having a radius greater than ¼ of the width of said damper wedge base wall; and said inclined damper wedge surface terminates at an outer edge of at least one of said radiused corners.

24. The damper wedge of claim 1 wherein there are four said damper wedges in a set for one end of a bolster of the railroad car truck, said four damper wedges including two said damper wedges with a left-hand beta angle, and two of said damper wedges having a right-hand beta angle.

25. The damper wedge of claim 1 in combination with the bolster pocket.

26. A railroad car truck comprising the damper wedge of claim 1 and at least one self-steering apparatus.

27. The railroad car truck of claim 26 wherein said self-steering apparatus includes a rocker located between a side frame pedestal and a wheelset axle bearing.

28. The railroad car truck of claim 27 wherein said railroad car truck has a side frame mounted to rock laterally sideways, said side frame having a lateral rocking stiffness $k_{pendulum}$; said railroad car truck has a bolster mounted on spring groups; and said spring groups have a lateral stiffness $k_{springshear}$, and $k_{pendulum}$ is less than $k_{springshear}$.

29. A damper wedge for a railroad car truck, said damper wedge being formed to co-operate with a bolster pocket, wherein said damper wedge comprises:

a friction member that, in use, movably engages a wear surface of a side frame column of the railroad car truck said friction member having a non-metallic wear surface;

a spring seat that, in use, engages a spring of the railroad car truck;

an inclined damper wedge surface, said inclined damper wedge surface having a primary angle alpha, a secondary angle beta; and a curvature having a working point at which said inclined surface engages the bolster pocket when the railroad car truck is at rest and, when in operation, engages the bolster pocket in rolling point contact, said spring seat having an axial centerline;

said damper wedge having a datum plane that is normal to said non-metallic wear surface and that contains said axial centerline;

said axial centerline meets said inclined damper wedge surface at an intersection point;

said damper wedge has a first end face and a second end face, said first and second end faces being spaced apart and opposed;

said datum plane being located mid-way between said first and second end faces; and said working point is located in a central region of said inclined damper wedge surface adjacent to said datum plane and downslope from said intersection point.

30. The damper wedge of claim 29 wherein said curvature has a radius of curvature in said datum plane of less than 30 inches.

31. The damper wedge of claim 29 wherein said damper wedge has first and second end faces, said datum plane is defined mid-way between said end faces, and said damper wedge is asymmetric.

32. A damper wedge for a railroad car truck, the damper wedge being sized to seat within a mating bolster pocket of a bolster of the railroad car truck, wherein said damper wedge comprises:

a body, having a friction face operable to engage a side frame column of the railroad car truck;

said friction face having a non-metallic wear surface;

said body having a spring seat sized to mate with an upper end of a spring of the railroad car truck;

said body having an inclined face that is configured to engage a corresponding inclined face of the bolster pocket;

said inclined face having a primary damper wedge angle and a secondary damper wedge angle;

said inclined face having a curvature;

in operation said inclined face of said damper wedge engaging said bolster pocket in rolling point contact; and said body having a first side face and an opposed second side face, and a central plane intermediate said first side face and said second side face;

said first side face being larger than said second side face;

said central plane being square to said friction face;

said central plane intersecting said inclined face; and said inclined face has a working point at which said inclined surface of said damper wedge engages the bolster pocket when the railroad car truck is at rest, said working point being located in said central plane.

33. A damper wedge operable to engage a bolster pocket of a railroad car truck bolster, wherein:

said damper wedge has an inclined face having a primary angle alpha and a secondary angle beta;

said inclined face has an outwardly convex compound surface operable to engage the bolster pocket at a working point;

said secondary angle beta defines a lateral bias direction of said damper wedge;

said damper wedge has a friction face that, in use, engages a side frame column wear surface of the railroad car truck;

said friction face has a non-metallic wear surface;

said friction face has a normal plane extending therethrough, said normal plane also extending in a direction of upward and downward sprung motion of the damper wedge in use;

said normal plane is centered on said non-metallic wear surface; and said working point lies on said normal plane.

34. A damper wedge for a railroad car truck, said damper wedge being formed to co-operate with a corresponding bolster pocket, wherein said damper wedge comprises:

a friction member that, in use, movable engages a wear surface of a side frame column of the railroad car truck;

said friction member having a non-metallic wear surface;

a spring seat that, in use, engages a spring of the railroad car truck; and an inclined damper wedge surface;

said inclined damper wedge surface having a primary damper wedge angle, and a secondary damper wedge angle;

said inclined damper wedge surface having a curvature;

said inclined damper wedge surface being a machined surface;

in operation, said curvature of said inclined damper wedge surface engaging the bolster pocket in rolling point contact;

said curvature having a working point that engages the bolster pocket when the railroad car truck is at rest;

said spring seat having an axial centerline;

said damper wedge having a datum plane that is normal to said non-metallic wear surface and that contains said axial centerline;

said axial centerline meets said inclined damper wedge surface at an intersection point; and said working point is located at a center of a contact patch that has a radius of less than 1.5 inches.

35. A damper wedge for a railroad car truck, said damper wedge having:

a friction surface that, in use, engages a side frame column wear plate of the railroad car truck;

said friction surface being a non-metallic wear surface;

a spring seat that, in use, engages a spring, said spring seat having an axial centerline;

a slope surface that, in use, engages a corresponding surface of a bolster pocket of a bolster of the railroad car truck; and a datum plane normal to said friction surface, and that is parallel to said axial centerline of said spring seat;

said slope surface having a spherical arc and a radius of curvature;

said slope surface having a primary damper wedge angle, and a cross-wise secondary damper wedge angle;

said slope surface having a working point that, at equilibrium, engages said bolster pocket in rolling point contact; and said radius of curvature of said slope surface having an origin, a radius passing through said origin and said working point diverging from said datum plane at a skew angle, said skew angle being said secondary damper wedge angle when said radius is viewed in a plane oriented at said primary damper wedge angle.

36. The damper wedge of claim 35 wherein said axial centerline of said spring seat lies in said datum plane.

37. The damper wedge of claim 35 wherein said radius of curvature is in the range of 15" to 30".

38. The damper wedge of claim 35 wherein said radius of curvature is in the range of 20", +/−1".

39. The damper wedge of claim 35 wherein said working point is offset between ⅛" and ⅝" further away from said non-metallic wear surface of said friction member than is said axial centerline.

40. The damper wedge of claim 35 wherein said working point is offset between ¼" and ¾" further away from said non-metallic wear surface of said friction member than is said axial centerline.

41. The damper wedge of claim 35 wherein said non-metallic wear surface is offset from said axial centerline by a first distance, $x_1$; said working point is offset from said centerline by a second distance $x_2$; and a ratio of $x_1$:$x_2$ is in the range of one of (a) 21:2 to 21:8; and (b) 10:3 to 40:3.

42. The damper wedge of claim 41 wherein the ratio is 5:1.

43. The damper wedge of claim 35 wherein said axial centerline intersects said sloped surface at a datum point, said datum point lies in said datum plane, and said working point is located less than 1 inch from said datum point.

* * * * *